United States Patent [19]

Ichijima et al.

[11] Patent Number: 4,824,772

[45] Date of Patent: Apr. 25, 1989

[54] SILVER HALIDE COLOR PHOTOGRAPHIC MATERIAL CONTAINING PYRAZOLOAZOLE COUPLER AND DIR COMPOUND

[75] Inventors: Seiji Ichijima; Keiji Mihayashi, both of Kanagawa, Japan

[73] Assignee: Fuji Photo Film Co., Ltd., Kanagawa, Japan

[21] Appl. No.: 947,341

[22] Filed: Dec. 29, 1986

[30] Foreign Application Priority Data

Dec. 26, 1985 [JP] Japan ..... 60-294548

[51] Int. Cl.[4] ..... G03C 7/32

[52] U.S. Cl. ..... 430/544; 430/558; 430/957

[58] Field of Search ..... 430/957, 558, 544

[56] References Cited

U.S. PATENT DOCUMENTS 4,248,962 2/1981 Lau ..... 430/385
4,618,573 10/1986 Okamura et al. ..... 430/558

FOREIGN PATENT DOCUMENTS 0262158 12/1985 Japan ..... 430/544
1028947 2/1986 Japan ..... 430/558
1156127 7/1986 Japan ..... 430/544

OTHER PUBLICATIONS

Research Disclosure, Color Photographic Light-Sensitive Material, 9/85.

*Primary Examiner*—Paul R. Michl
*Assistant Examiner*—Patrick A. Doody
*Attorney, Agent, or Firm*—Sughrue, Mion, Zinn, Macpeak, and Seas

[57] ABSTRACT

A silver halide color photographic material comprising a support having thereon at least one silver halide emulsion layer, wherein the material contains at least one compound represented by general formula (I) described below and at least one compound represented by general formula (II) described below.

A—PDI (I)

wherein A represents a group capable of releasing PDI upon reaction with an oxidation product of a developing agent; and PDI represents a group which forms a development inhibitor upon reaction with an oxidation product of a developing agent after being released from A;

(II)

wherein $R_1$ represents a hydrogen atom or a substituent; X represents a hydrogen atom or a group capable of being released upon coupling; Za, Zb and Zc each represents a methane group, a substituted methine group, =N— or —N—, wherein one of the Za—Zb bond and the Zb—Zc bond is a double bond and the other is a single bond; wherein $R_1$ or a substituted methine group represented by Za, Zb or Zc may be a divalent group which forms a polymer, including a dimer; and wherein X does not represent a group of a development inhibitor or a precursor thereof. The silver halide color photographic material has excellent sharpness and color reproducibility.

35 Claims, No Drawings

SILVER HALIDE COLOR PHOTOGRAPHIC MATERIAL CONTAINING PYRAZOLOAZOLE COUPLER AND DIR COMPOUND

FIELD OF THE INVENTION

The present invention relates to a silver halide color photographic material which has excellent sharpness and color reproducibility.

BACKGROUND OF THE INVENTION

It is known that upon color development of silver halide color photographic materials, the oxidation products of aromatic primary amine color developing agents react with couplers to form indophenol, indoaniline, indamine, azomethine, phenoxazine, phenazine and similar dyes, thereby forming color images. In this system, color reproduction is usually accomplished by the subtractive color process, i.e., silver halide emulsions selectively sensitive to blue, green and red, and yellow, magenta and cyan color couplers in a complementary relation therewith are used.

It is also heretofore known that couplers can be employed not only for forming dye images but also for the purpose of releasing photographically useful compounds. One example of couplers capable of releasing a photographically useful compound is a DIR coupler. The photographic functions of these couplers are described in T. H. James, *The Theory of the Photographic Process,* 4th Edition. pages 610 to 611 and page 343 (The Macmillan Co., New York, 1977), etc. More specifically, DIR couplers are employed in order to improve sharpness, graininess or color reproducibility. Examples of newly developed DIR couplers include the compounds as described in U.S. Pat. Nos. 4,248,962, 4,409,323, 4,421,845 and 4,477,563, etc.

5-Pyrazolone type couplers have been heretofore employed as magenta color image forming couplers. Examples of newly developed pyrazoloazole type couplers are described in U.S. Pat. Nos. 4,540,654 and 3,725,067.

These pyrazoloazole type couplers have excellent color reproducibility when they are employed as magenta color image forming couplers. However, it has been found that when they are used together with the DIR couplers as described above, the sharpness of color images formed is insufficient.

SUMMARY OF THE INVENTION

Therefore, an object of the present invention is to provide a silver halide color photographic material having improved sharpness.

Other objects of the present invention will become apparent from the following detailed description and examples provided hereinafter.

The above-described objects of the present invention have been met by a silver halide color photographic material comprising a support having thereon at least one silver halide emulsion layer, wherein said material contains at least one compound represented by general formula (I) described below and at least one compound represented by general formula (II) described below.

$$A—PDI \qquad (I)$$

wherein A represents a group capable of releasing PDI upon reaction with an oxidation product of a developing agent; and PDI represents a group which forms a development inhibitor upon reaction with an oxidation product of a developing agent after being released from A;

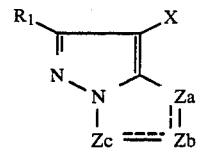

(II)

wherein $R_1$ represents a hydrogen atom or a substituent; X represents a hydrogen atom or a group capable of being released upon coupling; Za, Zb and Zc each represents a methine group, a substituted methine group, =N- or -NH-, wherein one of the Za—Zb bond and the Zb—Zc bond is a double bond and the other is a single bond; wherein $R_1$ or a substituted methine group represented by Za, Zb or Zc may be a divalent group which forms a polymer, including a dimer; and wherein X does not represent a group of a development inhibitor or a precursor thereof.

DETAILED DESCRIPTION OF THE INVENTION

The compound represented by general formula (I) is described in detail below.

Of the compounds represented by general formula (I), the preferred compounds are represented by general formula (III):

$$A—(L_1)_v—B—(L_2)_w—DI \qquad (III)$$

wherein A represents a group capable of releasing $(L_1)_v$—B—$(L_2)_w$—DI upon reaction with an oxidation product of a developing agent; $L_1$ represents a group capable of releasing B—$(L_2)_w$—DI after being released from A; B represents a group capable of releasing $(L_2)_w$—DI upon reaction with an oxidation product of a developing agent after being released from A—$(L_1)_v$; $L_2$ represents a group capable of releasing DI after being released from B, DI represents a development inhibitor; and v and w each represents 0 or 1.

The reaction process upon which the compound represented by general formula (III) releases DI at the time of development can be represented by the following schematic formulae:

$$A—(L_1)_v—B—(L_2)_w—DI \xrightarrow{T^{\oplus}} (L_1)_v—B—(L_2)_w—DI \longrightarrow$$

$$B—(L_2)_w—DI \xrightarrow{T^{\oplus}} (L_2)_w—DI \longrightarrow DI$$

wherein A, $L_1$, B, $L_2$, DI, v and w each has the same meaning as defined in general formula (III) above; and $T^{\oplus}$ represents an oxidation product of a developing agent.

In the above-described reaction formulae, the excellent effect obtained in the present invention is characterized by the reaction for forming $(L_2)_w$—DI from B—$(L_2)_w$—DI. Specifically, this reaction is a second order reaction between $T^{\oplus}$ and B—$(L_2)_w$—DI and the rate of the reaction depends on the concentration of each reactant. Therefore, B—$(L_2)_w$—DI immediately releases $(L_2)_w$—DI in a region where $T^{\oplus}$'s are generated in a large amount. In contrast therewith, in a region where $R^{\oplus}$'s are generated only in a small amount, B—$(L_2)_w$—DI slowly releases $(L_2)_w$—DI. Such a reaction process coupled with the above-described reaction processes effectively reveals the function of DI.

The compound represented by general formula (III) is described in greater detail below.

In the general formula (III), A preferably represents a coupler residue or an oxidation reduction group.

When A represents a coupler residue, any known coupler residue can be utilized. Suitable examples include a yellow coupler residue (for example, an open chain ketomethylene type coupler residue, etc.), a magenta coupler residue (for example, a 5-pyrazolone type coupler residue, a pyrazoloimidazole type coupler residue, a pyrazolotriazole type coupler residue, etc.), a cyan coupler residue (for example, a phenol type coupler residue, a naphthol type coupler residue, etc.), and a non-color-forming coupler residue (for example, an indanone type coupler residue, an acetophenone type coupler residue, etc.), etc.

When A represents an oxidation reduction group, the group is specifically represented by general formula (IV):

$$A_1—P—(X=Y)_n—Q—A_2 \qquad (IV)$$

wherein P and Q each represents an oxygen atom or a substituted or unsubstituted imino group; at least one of X and Y's represents a methine group having a group of —$(L_1)_v$—B—$(L_2)_w$—DI as a substituent, and the other of X and Y represents a substituted or unsubstituted methine group or a nitrogen atom; n represents an integer from 1 to 3 (when n is 2 or 3, each (X=Y) may be the same or different); $A_1$ and $A_2$ each represents a hydrogen atom or a group capable of being eliminated with an alkali; and any two substituents of P, X, Y, Q, $A_1$ and $A_2$ may be divalent groups and connected to each other to form a cyclic structure. Examples of the cyclic structure include a benzene ring or a pyridine ring, etc., formed by $(X=Y)_n$.

In general formula (III), the groups represented by $L_1$ and $L_2$ may or may not be used depending on the purpose. Preferred examples of the groups represented by $L_1$ and $L_2$ include the well-known linking groups described below.

(1) A group utilizing a cleavage reaction of hemiacetal.

These groups are described, for example, in U.S. Pat. No. 4,146,396, Japanese Patent Application (OPI) Nos. 249148/85, 249149/85 and 218645/85 (the term "OPI" as used herein refers to a "published unexamined Japanese patent application"), etc., and represented by general formula:

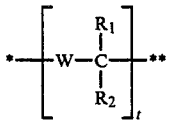

wherein a bond indicated by * denotes the position at which the group is connected to the left side group in general formula (III); a bond indicated by ** denotes the position at which the group is connected to the right side group in general formula (III); W represents an oxygen atom or a group represented by

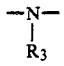

(wherein $R_3$ represents an organic substituent); $R_1$ and $R_2$ each represents a hydrogen atom or a substituent; t represents 1 or 2, when t represents 2, two $R_1$'s and two $R_2$'s may be the same or different; and any two of $R_1$, $R_2$ and $R_3$ may be connected to each other to form a cyclic structure.

(2) A group causing a cleavage reaction utilizing and intramolecular nucleophilic reaction.

Examples of these groups include the timing groups as described in U.S. Pat. No. 4,248,962, etc.

(3) A group causing a cleavage reaction utilizing an electron transfer reaction via a conjugated system.

Examples of these groups include those as described in U.S. Pat. No. 4,409,323, and the groups as described in British Pat. No. 2,096,783A and represented by general formula:

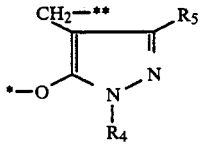

wherein a bond indicated by * denotes the position at which the group is connected to the left side group in general formula (III); a bond indicated by ** denotes the position at which the group is connected to the right side group in general formula (III); and $R_4$ and $R_5$ each represents a hydrogen atom or a substituent.

In general formula (III), the group represented by B is preferably a group capable of forming a coupler after being released from A—$(L_1)_v$ or a group capable of forming an oxidation reduction group after being released from A—$(L_1)_v$. Examples of the group forming a coupler include a group which is formed by eliminating a hydrogen atom from a hydroxy group of a phenol type coupler and is connected to A—$(L_1)_v$ at an oxygen atom of the hydroxy group, and a group which is formed by eliminating a hydrogen atom from a hydroxy group of a 5-hydroxypyrazole which is a tautomer of a 5-pyrazolone type coupler and is connected to A—$(L_1)_v$ at an oxygen atom of the hydroxy group. In these cases, the group forms a phenol type coupler or a 5-pyrazolone type coupler for the first time after being released from A—$(L_1)_v$. These couplers have $(L_2)_w$—DI at their coupling position.

When B represents a group capable of forming an oxidation reduction group, B is preferably represented by general formula (B-1):

$$*—P—(X'=Y')_n—Q—A_2 \qquad (B\text{-}1)$$

wherein a bond indicated by * denotes the position at which the group is connected to A—$(L_1)_v$—; $A_2$, P, Q and n each has the same meaning as defined in general formula (IV); at least one of X' and Y's represents a methine group having a group of $(L_2)_w$—DI as a substituent, and the other of X' and Y' represents a substituted or unsubstituted methine group or a nitrogen atom; and any two substituents of $A_2$, P, Q, X' and Y' may be divalent groups and connected to each other to form a cyclic structure.

In general formula (III), the group represented by DI preferably includes a 5-aromatic group-substituted tetrazolylthio group, a-aliphatic group-substituted tetrazolylthio group, a benzimidazolylthio group, a benzothiazolylthio group, a benzoxazolylthio group, a benzotriazolyl group, a benzindazolyl group, etc., and these groups may have an appropriate substituent.

In general formula (III), any two groups represented by A, $L_1$, B, $L_2$ and DI may have a bond in addition to the bond represented in general formula (III) and be connected to each other. In such cases, even when the second bond is not cleaved at the time of development, the effect of the present invention can be achieved. Examples of compounds including the bond are represented by general formulae:

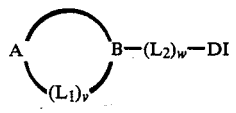

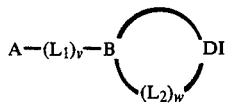

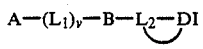

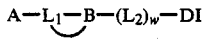

Of the compounds represented by general formula (III), preferred compounds are described in the following.

In the case wherein A represents a coupler residue, the effects of the present invention are particularly exhibited when A in general formula (III) represents a coupler residue represented by general formula (Cp-1), (Cp-2), (Cp-3), (Cp-4), (Cp-5), (Cp-6), (Cp-7), (Cp-8), (Cp-9), (Cp-10), or (Cp-11) described below. These coupler residues are preferred because of their high coupling rates.

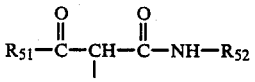

(Cp-1)

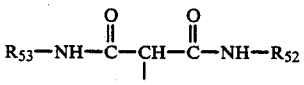

(Cp-2)

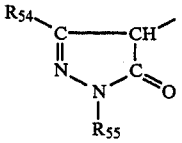

(Cp-3)

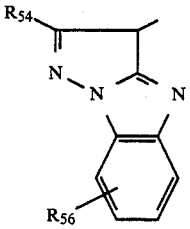

(Cp-4)

-continued

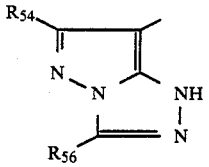

(Cp-5)

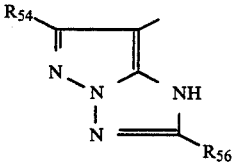

(Cp-6)

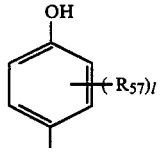

(Cp-7)

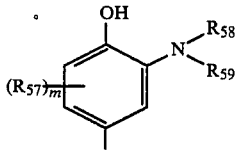

(Cp-8)

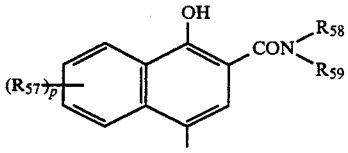

(Cp-9)

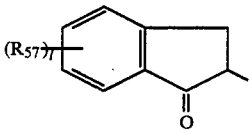

(Cp-10)

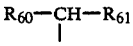

(Cp-11)

In the above-described formulae, a free bond attached to the coupling position indicates a position to which a group capable of being released upon coupling is connected. When $R_{51}$, $R_{52}$, $R_{53}$, $R_{54}$, $R_{55}$, $R_{56}$, $R_{57}$, $R_{58}$, $R_{59}$, $R_{60}$ or $R_{61}$ in the above-described formulae contains a diffusion resistant group, it is selected so that the total number of carbon atoms included therein is from 8 to 32 and preferably from 10 to 22. On the other hand, when it does not contain a diffusion resistant group, the total number of carbon atoms included therein is preferably not more than 15.

In the above-described formulae, $R_{51}$ represents an aliphatic group, an aromatic group, an alkoxy group or a heterocyclic group; and $R_{52}$ and $R_{53}$ each represents an aromatic group or a heterocyclic group.

The aliphatic group represented by $R_{51}$ is preferably an aliphatic group containing from 1 to 22 carbon atoms, and which may be substituted or unsubstituted, a chain form or a cyclic form, or saturated or unsaturated. Preferable substituents therefor include an alkoxy group, an aryloxy group, an amino group, an acylamino group, an aryl group, a halogen atom etc., which each may further have a substituent(s). Specific examples of the aliphatic groups useful for $R_{51}$ include an isopropyl group, an isobutyl group, a tert-butyl group, an isoamyl group, a tert-amyl group, a 1,1-dimethylbutyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an α-aminoisopropyl group, an α-(diethylamino)isopropyl group, an α-(succinimido)isopropyl group, an α-(phthalimido)isopropyl group, an α-(benzenesulfonamido)isopropyl group, etc.

In the case that $R_{51}$, $R_{52}$ or $R_{53}$ represents an aromatic group (especially a phenyl group), it may have a substituent. Such an aryl group as a phenyl group, etc., may be substituted with an alkyl group, an alkenyl group, an alkoxy group, an alkoxycarbonyl group, an alkoxycarbonylamino group, an aliphatic amido group, an alkylsulfamoyl group, an alkylsulfonamido group, an alkylureido group, an alkyl-substituted succinimido group, etc., each containing 32 or less carbon atoms. The alkyl group therein may include an alkyl group which contains an aromatic group such as phenylene in its main chain. Further, a phenyl group represented by $R_{51}$, $R_{52}$ and $R_{53}$ may be substituted with an aryloxy group, an aryloxycarbonyl group, an arylcarbamoyl group, an arylamido group, an arylsulfamoyl group, an arylsulfonamido group, an arylureido group, etc., the aryl moiety of which groups each may be substituted with one or more alkyl groups wherein the number of carbon atoms is from 1 to 22 in total.

Furthermore, a phenyl group represented by $R_{51}$, $R_{52}$ or $R_{53}$ may be substituted with an amino group which includes an amino group substituted with a lower alkyl group having from 1 to 6 carbon atoms, a hydroxy group, a carboxy group, a sulfo group, a nitro group, a cyano group, a thiocyano group or a halogen atom.

In addition, $R_{51}$, $R_{52}$ or $R_{53}$ may represent a substituent formed by condensing a phenyl group and another ring, such as a naphthyl group, a quinolyl group, an isoquinolyl group, a chromanyl group, a coumaranyl group, a tetrahydronaphthyl group, etc. These substituents may also have substituents thereon.

In the case that $R_{51}$ represents an alkoxy group, the alkyl moiety thereof represents a straight chain or branched chain alkyl group having from 1 to 32 carbon atoms, preferably from 1 to 22 carbon atoms, an alkenyl group, a cyclic alkyl group or a cyclic alkenyl group, which each may be substituted with a halogen atom, an aryl group, an alkoxy group, etc.

In the case that $R_{51}$, $R_{52}$ or $R_{53}$ represents a heterocyclic group, the heterocyclic group is bonded to the carbon atom of the carbonyl group of the acyl moiety or the nitrogen atom of the amido moiety of an α-acylacetamido group through one of the carbon atoms forming the ring. Examples of such heterocyclic rings include thiophene, furan, pyran, pyrrole, pyrazole, pyridine, pyrazine, pyrimidine, pyridazine, indolizine, imidazole, thiazole, oxazole, triazine, thiadiazine, oxazine, etc. These rings may also have substituents on the individual rings.

In the above-described formula (Cp-3), $R_{55}$ represents a straight chain or branched chain alkyl group having from 1 to 32 carbon atoms, preferably from 1 to 22 carbon atoms (e.g., a methyl group, an isopropyl group, a tert-butyl group, a hexyl group, a dodecyl group, etc.), an alkenyl group (e.g., an allyl group, etc.), a cyclic alkyl group (e.g., a cyclopentyl group, a cyclohexyl group, a norbornyl group, etc.), an aralkyl group (e.g., a benzyl group, a β-phenylethyl group, etc.), a cyclic alkenyl group (e.g., a cyclopentenyl group, a cyclohexenyl group, etc.), etc., which groups each may be substituted with a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group, a mercapto group, etc.

$R_{55}$ may further represent an aryl group (e.g., a phenyl group, an α- or β-naphthyl group, etc.). The aryl group may have one or more substituents. Examples of the substituents include an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxy group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxy group, etc.

Furthermore, $R_{55}$ may represent a heterocyclic group (e.g., a 5-membered or 6-membered heterocyclic ring containing as a hetero atom a nitrogen atom, an oxygen atom or a sulfur atom, or a condensed ring thereof, with specific examples including a pyridyl group, a quinolyl group, a furyl group, a benzothiazolyl group, an oxazolyl group, an imidazolyl group, a naphthoxazolyl group, etc.), a heterocyclic group substituted with one or more substituents as defined for the above-described aryl group, an aliphatic acyl group, an aromatic acyl group, an alkylsulfonyl group, an arylsulfonyl group, an alkylcarbamoyl group, an arylcarbamoyl group, an alkylthiocarbamoyl group or an arylthiocarbamoyl group.

In the above-described general formulae, $R_{54}$ represents a hydrogen atom, a straight chain or branched chain alkyl group having from 1 to 32 carbon atoms, preferably from 1 to 22 carbon atoms, an alkenyl group, a cyclic alkyl group, an aralkyl group or a cyclic alkenyl group (which each may have one or more substituents as defined for the above-described substituent $R_{55}$), an aryl group or a heterocyclic group (which each also may have one or more substituents as defined for the above-described substituent $R_{55}$), an alkoxycarbonyl group (e.g., a methoxycarbonyl group, an ethoxycarbonyl group, a stearyloxycarbonyl group, etc.), an aryloxycarbonyl group (e.g., a phenoxycarbonyl group, a naphthoxycarbonyl group, etc.), an aralkyloxycarbonyl group (e.g., a benzyloxycarbonyl group, etc.), an alkoxy group (e.g., a methoxy group, an ethoxy group, a heptadecyloxy group, etc.), an aryloxy group (e.g., a phenoxy group, a tolyloxy group, etc.), an alkylthio group (e.g., an ethylthio group, a dodecylthio group, etc.), an arylthio group (e.g., a phenylthio group, an α-naphthylthio group, etc.), a carboxy group, an acylamino group (e.g., an acetylamino group, a 3-[(2,4-di-tert-amylphenoxy)acetamido]benzamido group, etc.), a diacylamino group, an N-alkylacylamino group (e.g., an N-methylpropionamido group, etc.), an N-arylacylamino group (e.g., an N-phenylacetamido group, etc.), a ureido group (e.g., a ureido group, an N-arylureido group, an N-alkylureido group, etc.), a urethane group, a thiourethane group, an arylamino group (e.g., a phenylamino group, an N-methylanilino group, a diphenylamino group, an N-acetylanilino group, a 2-chloro-5-tetradecanamidoanilino group, etc.), an alkylamino group (e.g., an n-butylamino group, a methylamino group, a cyclohexylamino group, etc.), a cycloamino group (e.g., a piperidino group, a pyrrolidino group, etc.), a heterocyclic amino group (e.g., a 4-pyridylamino group, a 2-benzoxazolylamino group, etc.), an alkylcarbonyl group (e.g., a methylcarbonyl group, etc.), an arylcarbonyl group (e.g., a phenylcarbonyl group, etc.), a sulfonamido group (e.g., an alkylsulfonamido group, an arylsulfonamido group, etc.), a carbamoyl group (e.g., an ethylcarbamoyl group, a dimethylcarbamoyl group, an N-methylphenylcarbamoyl group, an N-phenylcarbamoyl group, etc.), a sulfamoyl group (e.g., an N-alkylsulfamoyl group, an N,N-dialkylsulfamoyl group, an N-arylsulfamoyl group, an N-alkyl-N-arylsulfamoyl group, an N,N-diarylsulfamoyl group, etc.), a cyano group, a hydroxy group or a sulfo group.

In the above-described formulae, $R_{56}$ represents a hydrogen atom, or a straight chain or branched chain alkyl group having from 1 to 32 carbon atoms, preferably from 1 to 22 carbon atoms, an alkenyl group, a cyclic alkyl group, an aralkyl group or a cyclic alkenyl group, which each may have one or more substituents as defined for the above-described substituent $R_{55}$.

Further, $R_{56}$ may represent an aryl group or a heterocyclic group, which each may have one or more substituents as defined for the above-described substituent $R_{55}$.

Furthermore, $R_{56}$ may represent a cyano group, an alkoxy group, an aryloxy group, a halogen atom, a carboxy group, an alkoxycarbonyl group, an aryloxycarbonyl group, an acyloxy group, a sulfo group, a sulfamoyl group, a carbamoyl group, an acylamino group, a diacylamino group, a ureido group, a urethane group, a sulfonamido group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group or a hydroxy group.

In the above-described formulae, $R_{57}$, $R_{58}$ and $R_{59}$ each represents a group which has been employed in conventional 4-equivalent type phenol or α-naphthol couplers. Specifically, $R_{57}$ represents a hydrogen atom, a halogen atom, an alkoxycarbonylamino group, an aliphatic hydrocarbon residue, an N-arylureido group, a sulfamoyl group, a sulfonamido group, an acylamino group, an —O—$R_{62}$ group or an —S—$R_{62}$ group (wherein $R_{62}$ is an aliphatic hydrocarbon residue). When two or more of $R_{57}$'s are present in one molecule, they may be different from each other. The above-described aliphatic hydrocarbon residues include those having substituents. In the case that these substituents include an aryl group, the aryl group may have one or more substituents as defined for the above-described substituent $R_{55}$.

$R_{58}$ and $R_{59}$ each represents an aliphatic hydrocarbon residue, an aryl group or a heterocyclic residue. Either of them may be a hydrogen atom. The above-described groups for $R_{58}$ and $R_{59}$ may further have certain substituents. Furthermore, $R_{58}$ and $R_{59}$ may combine with each other to form a nitrogen-containing heterocyclic nucleus. More specifically, the above-described aliphatic hydrocarbon residue includes both saturated and unsaturated ones, which each may have a straight chain form, a branched chain form or a cyclic form. Preferred examples thereof include an alkyl group (e.g., a methyl group, an ethyl group, a propyl group, an isopropyl group, a butyl group, a tert-butyl group, an isobutyl group, a dodecyl group, an octadecyl group, a cyclobutyl group, a cyclohexyl group, etc.) and an alkenyl group (e.g., an allyl group, an octenyl group, etc.). The above-described aryl group includes a phenyl group, a naphthyl group, etc. Representatives of the above-described heterocyclic group include a pyridinyl group, a quinolyl group, a thienyl group, a piperidyl group, an imidazolyl group, etc. These aliphatic hydrocarbon residues, aryl groups and heterocyclic residues each may be substituted with a halogen atom, a nitro group, a hydroxy group, a carboxy group, an amino group, a substituted amino group, a sulfo group, an alkyl group, an alkenyl group, an aryl group, a heterocyclic group, an alkoxy group, an aryloxy group, an arylthio group, an arylazo group, an acylamino group, a carbamoyl group, an ester group, an acyl group, an acyloxy group, a sulfonamido group, a sulfamoyl group, a sulfonyl group, a morpholino group, etc.

In the above-described formulae, l represents an integer of 1 to 4, m represents an integer of 1 to 3, and p represents an integer of 1 to 5.

In the above-described formula, $R_{60}$ represents an arylcabonyl group, an alkanoyl group having from 2 to 32 carbon atoms, preferably from 2 to 22 carbon atoms, an arylcarbamoyl group, an alkanecarbamoyl group having from 2 to 32 carbon atoms, preferably from 2 to 22 carbon atoms, an alkoxycarbonyl group having from 1 to 32 carbon atoms, preferably from 1 to 22 carbon atoms or an aryloxycarbonyl group, which each may be substituted. Examples of the substituents include an alkoxy group, an alkoxycarbonyl group, an acylamino group, an alkylsulfamoyl group, an alkylsulfonamido group, an alkylsuccinimido group, a halogen atom, a nitro group, a carboxyl group, a nitrile group, an alkyl group, an aryl group, etc.

In the above-described formula, $R_{61}$ represents an arylcarbonyl group, an alkanoyl group having from 2 to 32 carbon atoms, preferably from 2 to 22 carbon atoms, an arylcarbamoyl group, an alkanecarbamoyl group having from 2 to 32 carbon atoms, preferably from 2 to 22 carbon atoms, an alkoxycarbonyl group having from 1 to 32 carbon atoms, preferably from 1 to 22 carbon atoms, an aryloxycarbonyl group, an alkylsulfonyl group having from 1 to 32 carbon atoms, preferably from 1 to 22 carbon atoms, an arylsulfonyl group, an aryl group or a 5-membered or 6-membered heterocyclic group (containing as a hetero atom, a nitrogen atom, an oxygen atom or a sulfur atom, with specific examples including a triazolyl group, an imidazolyl group, a phthalimido group, a succinimido group, a furyl group, a pyridyl group, a benzotriazolyl group, etc.), which each may have one or more substituents as defined for the above-described substituent $R_{60}$.

Of the above-described coupler residues, those represented by general formula (Cp-1) wherein $R_{51}$ represents a tert-butyl group or a substituted or unsubstituted aryl group and $R_{52}$ represents a substituted or unsubstituted aryl group, and those represented by general formula (Cp-2) wherein $R_{52}$ and $R_{53}$ each represents a substituted or unsubstituted aryl group are preferred as yellow coupler residues.

As magenta coupler residues, those represented by general formula (Cp-3) wherein $R_{54}$ represents an acylamino group, a ureido group or an arylamino group and $R_{55}$ represents a substituted aryl group, those represented by general formula (Cp-4) wherein $R_{54}$ represents an acylamino group, a ureido group or an arylamino group and $R_{56}$ represents a hydrogen atom, and those represented by general formula (Cp-5) or (Cp-6) wherein $R_{54}$ and $R_{56}$ each represents a straight chain or branched chain alkyl group, an alkenyl group, a cyclic alkyl group, an aralkyl group, a cyclic alkenyl group, an alkoxy group, a ureido group or an acylamino group are preferred.

As cyan couplers, those represented by general formula (Cp-7) wherein $R_{57}$ represents an acylamino group or a ureido group at the 2-position, an acylamino group or an alkyl group at the 5-position and a hydrogen atom or a chlorine atom at the 6-position, and those represented by general formula (Cp-9) wherein $R_{57}$ represents a hydrogen atom, an acylamino group, a sulfonamido group or an alkoxycarbonyl group at the 5-position, $R_{58}$ represents a hydrogen atom and $R_{59}$ represents a phenyl group, an alkyl group, an alkenyl group, a cyclic alkyl group, an aralkyl group or a cyclic alkenyl group are preferred.

As non-color-forming coupler residues, those represented by general formula (Cp-10) wherein $R_{57}$ represents an acylamino group, a sulfonamido group or a sulfamoyl group, and those represented by general formula (Cp-11) wherein $R_{60}$ and $R_{61}$ each represents an alkoxycarbonyl group are preferred.

Further, by connecting any of the groups represented by $R_{51}$ to $R_{61}$, a polymeric compound including a bis compound or more may be formed. Moreover, a polymer composed of a monomer which is formed by containing an ethylenically unsaturated group in any of the groups represented by $R_{51}$ to $R_{61}$ or a copolymer composed of the coupler monomer described above and a non-color-forming monomer may be employed.

Of the compounds represented by general formula (III) wherein A represents a group represented by general formula (IV), preferred compounds are described in the following.

When P and Q each represents a substituted or unsubstituted imino group, an imino group substituted with a sulfonyl group or an acyl group is preferred. In such a case, P or Q is represented by the following general formula (N-1) or (N-2):

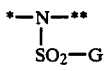
(N-1)

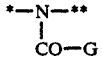
(N-2)

wherein a bond indicated by * denotes the position at which the group is connected to $A_1$ or $A_2$; a bond indicated by ** denotes the position at which the group is connected to one of the free bonds of $-(X{=}Y)_n-$; and G represents an aliphatic group containing from 1 to 32 carbon atoms, preferably from 1 to 22 carbon atoms, which may be a straight chain, branched chain or cyclic, saturated or unsaturated or substituted or unsubstituted (for example, a methyl group, an ethyl group, a benzyl group, a phenoxybutyl group, an isopropyl group, etc.), a substituted or unsubstituted aromatic group containing from 6 to 10 carbon atoms (for example, a phenyl group, a 4-methylphenyl group, a 1-naphthyl group, a 4-dodecyloxyphenyl group, etc.) or a 4-membered to 7-membered heterocyclic group containing as a hetero atom a nitrogen atom, a sulfur atom or an oxygen atom (for example, a 2-pyridyl group, a 1-phenyl-4-imidazolyl group, a 2-furyl group, a benzothienyl group, etc.).

When $A_1$ and $A_2$ each represents a group capable of being eliminated with an alkali (hereinafter referred to as a precursor group), preferred examples of the precursor groups include a hydrolyzable group, for example, an acyl group, an alkoxycarbonyl group, an aryloxycarbonyl group, a carbamoyl group, an imidoyl group, an oxazolyl group, a sulfonyl group, etc.; a precursor group of the type utilizing a reversal Michel reaction as described in U.S. Pat. No. 4,009,029, etc.; a precursor group of the type utilizing an anion generated after a ring cleavage reaction as an intramolecular nucleophilic group as described in U.S. Pat. No. 4,310,612, etc.; a precursor group utilizing an electron transfer of an anion via a conjugated system whereby a cleavage reaction occurs as described in U.S. Pat. Nos. 3,674,478, 3,932,480 and 3,993,661, etc.; a precursor group utilizing an electron transfer of an anion reacted after a ring cleavage reaction whereby a cleavage reaction occurs as described in U.S. Pat. No. 4,335,200; or a precursor group utilizing an imidomethyl group as described in U.S. Pat. Nos. 4,363,865 and 4,410,618, etc.

In general formula (IV), it is preferred that P represents an oxygen atom and $A_2$ represents a hydrogen atom.

It is more preferred that in general formula (IV), X and Y each represents a substituted or unsubstituted methine group except X or Y represents a methine group having a group of $-(L_1)_v-B-(L_2)_w-DI$ as a substituent.

Of the groups represented by general formula (IV), those particularly preferred are represented by the following general formula (V) or (VI):

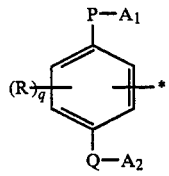
(V)

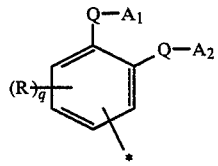
(VI)

wherein a bond indicated by * denotes the position at which the group is connected to $-(L_1)_v-B-(L_2)_w-DI$; P, Q, $A_1$ and $A_2$ each has the same meaning as defined in general formula (IV); R represents a substituent; q represents an integer of 0, 1, 2 or 3; and when q represents 2 or 3, two or three R's may be the same or different, or when two R's represent substituents positioned on the adjacent two carbon atoms, they may be divalent groups and connected to each other to form a cyclic structure.

Examples of the cyclic structures formed by condensing the benzene ring and another ring include a naphthalene ring, a benzonorbornene ring, a chroman ring, an indole ring, a benzothiophene ring, a quinoline ring, a benzofuran ring, a 2,3-dihydrobenzofuran ring, an indane ring, an indene ring, etc. These rings may further have one or more substituents.

Preferred examples of the substituents represented by R and the substituents on the condensed ring described above include an aliphatic group (for example, a methyl group, an ethyl group, an allyl group, a benzyl group, a dodecyl group, etc.), an aromatic group (for example, a phenyl group, a naphthyl group, a 4-phenoxycarbonylphenyl group, etc.), a halogen atom (for example, a chlorine atom, a bromine atom, etc.) an alkoxy group (for example, a methoxy group, a hexadecyloxy group, etc.), an alkylthio group (for example, a methylthio group, a dodecylthio group, a benzylthio group, etc.), an aryloxy group (for example, a phenoxy group, a 4-tert-octylphenoxy group, a 2,4-di-tert-amylphenoxy group, etc.), an arylthio group (for example, a phenylthio group, a 4-dodecyloxyphenylthio group, etc.), a carbamoyl group (for example, an N-ethylcarbamoyl group, an N-hexadecylcarbamoyl group, an N-3-(2,4-di-tert-amylphenoxy)propylcarbamoyl group, an N-methyl-N-octadecylcarbamoyl group, etc.), an alkoxycarbonyl group (for example, a methoxycarbonyl group, a 2-cyanoethoxycarbonyl group, an ethoxycarbonyl group, a dodecyloxycarbonyl group, a 3-(2,4-di-tert-amylphenoxy)propoxycarbonyl group, etc.), an aryloxycarbonyl group (for example, a phenoxycarbonyl group, a 4-nonylphenoxycarbonyl group, etc.), a sulfonyl group (for example, a methanesulfonyl group, a benzenesulfonyl group, a p-toluenesulfonyl group, etc.), a sulfamoyl group (for example, an N-propylsulfamoyl group, an N-methyl-N-octadecylsulfamoyl group, an N-phenylsulfamoyl group, an N-dodecylsulfamoyl group, etc.), an acylamino group (for example, an acetamido group, a benzamido group, a tetradecanamido group, a 4-(2,4-di-tert-amylphenoxy)butanamido group, a 2-(2,4-di-tert-amylphenoxy)butanamido group, a 2-(2,4-di-tert-amylphenoxy)tetradecanamido group, etc.), a sulfonamido group (for example, a methanesulfonamido group, a benzenesulfonamido group, a hexadecylsulfonamido group, etc.), an acyl group (for example, an acetyl group, a benzoyl group, a myristoyl group, a palmitoyl group, etc.), a nitroso group, an acyloxy group (for example, an acetoxy group, a benzoyloxy group, a lauryloxy group, etc.), a ureido group (for example, a 3-phenylureido group, a 3-(4-cyanophenylureido group, etc.), a nitro group, a cyano group, a heterocyclic group (preferably a 4-membered, 5-membered or 6-membered heterocyclic group containing a nitrogen atom, an oxygen atom or a sulfur atom as a hetero atom, for example, a 2-furyl group, a 2-pyridyl group, a 1-imidazolyl group, a 1-morpholino group, etc.), a hydroxy group, a carboxyl group, an alkoxycarbonylamino group (for example, a methoxycarbonylamino group, a phenoxycarbonylamino group, a dodecyloxycarbonylamino group, etc.), a sulfo group, an amino group, a arylamino group (for example, an anilino group, a 4-methoxycarbonylanilino group, etc.), an aliphatic amino group (for example, an N,N-diethylamino group, a dodecylamino group, etc.), a sulfinyl group (for example, a benzenesulfinyl group, a propylsulfinyl group, etc.), a sulfamoylamino group (for example, a 3-phenylsulfamoylamino group, etc.), a thioacyl group (for example, a thiobenzoyl group, etc.), a thioureido group (for example, a 3-phenylthioureido group, etc.), a heterocyclic thio group (for example, a thiadiazolylthio group, etc.), an imido group (for example, a succinimido group, a phthalimido group, an octadecenylimido group, etc.), or a heterocyclic amino group (for example, a 4-imidazolylamino group, a 4-pyridylamino group, etc.), etc.

The aliphatic moiety included in the abovedescribed substituents may have from 1 to 32 carbon atoms, preferably from 1 to 20 carbon atoms, and may be a straight chain, branched chain or cyclic, saturated or unsaturated, substituted or unsubstituted aliphatic group.

The aromatic moiety included in the abovedescribed substituents may have from 6 to 10 carbon atoms and is preferably a substituted or unsubstituted phenyl group.

It is preferred that the group represented by B in general formula (III) is a group represented by general formula (B-1).

In the general formula (B-1), P preferably represents an oxygen atom and Q preferably represents an oxygen atom or one of the following groups:

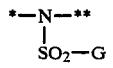

and

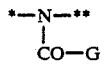

wherein a bond indicated by * denotes the position at which the group is connected to $-(X'=Y')_n-$; a bond indicated by ** denotes the position at which the group is connected to $A_2$; and G has the same meaning as defined in the general formula (N-1) or (N-2).

Further, the effects of the present invention are particularly exhibited when the group represented by B in general formula (III) represents a group represented by general formula (B-2) or (B-3):

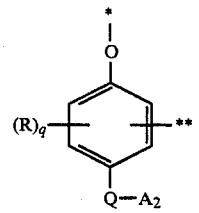

(B-2)

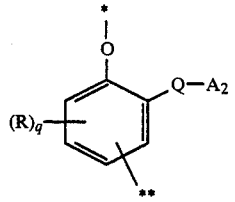

(B-3)

wherein a bond indicated by * denotes the position at which the group is connected to $A-(L_1)_v-$; a bond indicated by ** denotes the position at which the group is connected to $-(L_2)_w-DI$; and R, q, Q and $A_2$ each has the same meaning as defined in the general formula (V) or (VI).

In general formula (III), preferred examples of the development inhibitors represented by DI include a 5-aromatic group-substituted tetrazolylthio group (the aromatic group having preferably from 6 to 10 carbon atoms), a 5-aliphatic group-substituted tetrazolylthio group (the aliphatic group having preferably from 1 to 10 carbon atoms) and a benzotriazolyl group. These groups may have one or more substituents which may be selected from those defined for R in the general formula (V) or (VI) described above.

In general formula (III), it is preferred that both v and w are 0.

It is particularly preferred that the group represented by A is a coupler residue.

In the following, more preferred embodiments according to the present invention are described.

The compounds which are incorporated in a green-sensitive silver halide emulsion layer are preferably those represented by the general formula (III) wherein A represents a coupler residue represented by the general formula (Cp-1), (Cp-3), (Cp-6), (Cp-7), (Cp-8) or (Cp-10).

The couplers according to the present invention may be employed together with other known DIR couplers, for example, those as described in U.S. Pat. Nos. 4,477,563, 4,248,962, 4,409,323 and 4,421,845, etc.

Specific examples of the compounds represented by the general formula (I) and synthesis methods thereof are described, for example, in Japanese Patent Application (OPI) Nos. 185950/85, 240240/86, 231553/86, 233741/86, 203943/85, 236551/86 and 236550/86, Japanese Patent Application (OPI) No. 278852/86.

The compound represented by general formula (II) is described in detail below.

The compounds represented by general formula (II) are nitrogen-containing heterocyclic 5-membered ring-condensed 5-membered ring type couplers. Their color forming nuclei show aromaticity isoelectronic to naphthalene and have chemical structures inclusively called azapentalene. The preferred compounds among the couplers represented by general formula (II) are 1H-imidazo[1,2,b]pyrazoles, 1H-pyrazolo[1,5-b]pyrazoles, 1H-pyrazolo[5,1-c][1,2,4]triazoles, 1H-pyrazolo[1,5-b][1,2,4]triazoles, 1H-pyrazolo[1,5-d]tetrazoles and 1H-pyrazolo[1,5-a]benzimidazoles represented by general formulae (VII), (VIII), (IX), (X) and (XI) described below, respectively. Of them, the compounds represented by general formulae (VII) and (X) are particularly preferred.

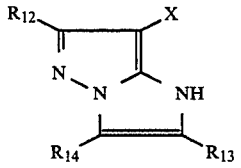
(VII)

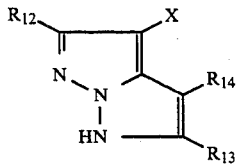
(VIII)

-continued

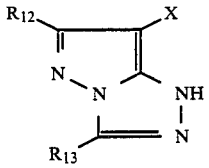
(IX)

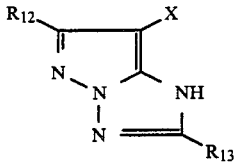
(X)

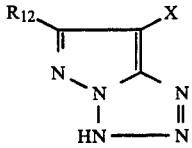
(XI)

In the general formula (VII), (VIII), (IX), (X) or (XI), $R_{12}$, $R_{13}$ and $R_{14}$, which may be the same or different, each represents a hydrogen atom, a halogen atom, an alkyl group, an aryl group, a heterocyclic group, a cyano group, an alkoxy group, an arylxoy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; and X has the same meaning as defined in general formula (II).

In general formula (VII), $R_{13}$ and $R_{14}$ may be connected to form a benzene ring.

Also, $R_{12}$, $R_{13}$, $R_{14}$ or X may be a divalent group to form a bis coupler. Further, the coupler represented by the general formula (VII), (VIII), (IX), (X) or (XI) may be in the form of a polymer coupler in which the general formula constitutes a partial structure of a vinyl monomer and $R_{12}$, $R_{13}$ or $R_{14}$ represents a chemical bond or a linking group, through which the partial structure of the formula (VII), (VIII), (IX), (X) or (XI) and the vinyl group are connected together.

In more detail, $R_{12}$, $R_{13}$ and $R_{14}$ each represents a hydrogen atom, a halogen atom (e.g., a chlorine atom, a bromine atom, etc.) an alkyl group (e.g., a methyl group, a propyl group, a tert-butyl group, a trifluoromethyl group, a tridecyl group, a 3-(2,4-di-tert-amylphenoxy)propyl group, a 2-dodecyloxyethyl group, a 3-phenoxypropyl group, a 2-hexylsulfonylethyl group, a cyclopentyl group, a benzyl group, etc.), an aryl group (e.g., a phenyl group, a 4-tert-butylphenyl group, a 2,4-di-tert-amylphenyl group, a 4-tetradecanamidophenyl group, etc.), a heterocyclic group (e.g., a 2-furyl group, a 2-thienyl group, a 2-pyrimidinyl group, a 2-benzothiazolyl group, etc.), a cyano group, an alkoxy group (e.g., a methoxy group, an ethoxy group, a 2-methoxyethoxy group, a 2-dodecyloxyethoxy group, a 2-methanesulfonylethoxy group, etc.), an aryloxy group (e.g., a phenoxy group, a 2-methylphenoxy group, a 4-tert-butylphenoxy group, etc.), a heterocyclic oxy group (e.g., a 2-benzimidazolyloxy group, etc.), an acyloxy group (e.g., an acetoxy group, a hexadecanoyloxy group, etc.), a carbamoyloxy group (e.g., an N-phenylcarbamoyloxy group, an N-ethylcarbamoyloxy group, etc.), a silyloxy group (e.g., a trimethylsilyloxy group, etc.), a sulfonyloxy group (e.g., a dodecylsulfonyloxy group, etc.), an acylamino group (e.g., an acetamido group, a benzamido group, a tetradecanamido group, an α-(2,4-di-tert-amylphenoxy)-butyramido group, a γ-(3-tert-butyl-4-hydroxyphenoxy)butyramido group, an α-[4-(4-hydroxyphenylsulfonyl)phenoxy]decanamido group, etc.), an anilino group (e.g., a phenylamino group, a 2-chloroanilino group, a 2-chloro-5-tetradecanamidoanilino group, a 2-chloro-5-dodecyloxycarbonylanilino group, an N-acetylanilino group, a 2-chloro-5 -[α-(2-tert-butyl-4-hydroxyphenoxy)dodecanamido]anilino group, etc.), a ureido group (e.g., a phenylureido group, a methylureido group, an N,N-dibutylureido group, etc.), an imido group (e.g., an N-succinimido group, a 3-benzylhydantoinyl group, a 4-(2-ethylhexanoylamino)phthalimido group, etc.), a sulfamoylamino group (e.g., an N,N-dipropylsulfamoylamino group, an N-methyl-N-decylsulfamoylamino group, etc.), an alkylthio group (e.g., a methylthio group, an octylthio group, a tetradecylthio group, a 2-phenoxyethylthio group, a 3-phenoxypropylthio group, a 3-(4-tert-butylphenoxy)propylthio group, etc.), an arylthio group (e.g., a phenylthio group, a 2-butoxy-5-tert-octylphenylthio group, a 3-pentadecylphenylthio group, a 2-carboxyphenylthio group, a 4-tetradecanamidophenylthio group, etc.), a heterocyclic thio group (e.g., a 2-benzothiazolylthio group, etc.), an alkoxycarbonylamino group (e.g., a methoxycarbonylamino group, a tetradecyloxycarbonylamino group, etc.), an aryloxycarbonylamino group (e.g., a phenoxycarbonylamino group, a 2,4-di-tert-butylphenoxycarbonylamino group, etc.), a sulfonamido group (e.g., a methanesulfonamido group, a hexadecanesulfonamido group, a benzenesulfonamido group, a p-toluenesulfonamido group, an octadecanesulfonamido group, a 2-methyloxy-5-tert-butylbenzenesulfonamido group, etc.), a carbamoyl group (e.g., an N-ethylcarbamoyl group, an N,N-dibutylcarbamoyl group, an N-(2-dodecyloxyethyl)carbamoyl group, an N-methyl-N-dodecylcarbamoyl group, an N-[3-(2,4-di-tert-amylphenoxy)propyl]carbamoyl group, etc.), an acyl group (e.g., an acetyl group, a (2,4-di-tert-amylphenoxy)acetyl group, a benzoyl group, etc.), a sulfamoyl group (e.g., an N-ethylsulfamoyl group, an N,N-dipropylsulfamoyl group, an N-(2-dodecyloxyethyl)sulfamoyl group, an N-ethyl-N-dodecylsulfamoyl group, an N,N-diethylsulfamoyl group, etc.), a sulfonyl group (e.g., a methanesulfonyl group, an octanesulfonyl group, a benzenesulfonyl group, an toluenesulfonyl group, etc.), a sulfinyl group (e.g., an octanesulfinyl group, a dodecylsulfinyl group, a phenylsulfinyl group, etc.), an alkoxycarbonyl group (e.g., a methoxycarbonyl group, a butyloxycarbonyl group, a dodecyloxycarbonyl group, an octadecyloxycarbonyl group, etc.) or an aryloxycarbonyl group (e.g., a phenyloxycarbonyl group, a 3-pentadecylphenyloxycarbonyl group, etc.).

When $R_{12}$, $R_{13}$ or $R_{14}$ represents a divalent group to form a bis coupler, such a divalent group includes a substituted or unsubstituted alkylene group (e.g., a methylene group, an ethylene group, a 1,10-decylene group, —$CH_2CH_2$—O—$CH_2CH_2$—, etc.), a substituted or unsubstituted phenylene group (e.g, a 1,4-phenylene group, a 1,3-phenylene group,

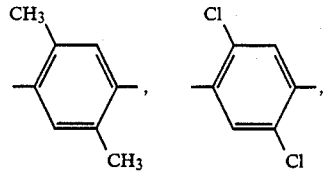

etc.), an —NHCO—$R_{12}$—CONH— group (wherein $R_{12}$ represents a substituted or unsubstituted alkylene or phenylene group).

The linking group represented by $R_{12}$, $R_{13}$ or $R_{14}$ in the cases wherein the coupler moiety represented by general formula (VII), (VIII), (IX), (X) or (XI) is included in a vinyl monomer includes an alkylene group (including a substituted or unsubstituted alkylene group, e.g., a methylene group, an ethylene group, a 1,10-decylene group, —$CH_2CH_2OCH_2CH_2$—, etc.), a phenylene group (includinga substituted or unsubstituted phenylene group, e.g., a 1,4-phenylene group, a 1,3-phenylene group,

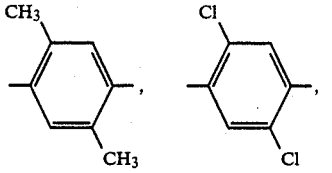

etc.), —NHCO—, —CONH—, —O—, —OCO—, and an aralkylene group (e.g.,

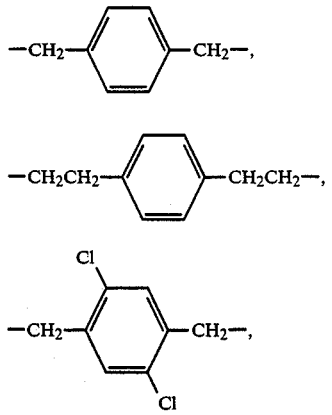

etc.) or a combination thereof.

Further, a vinyl group in the vinyl monomer may further have a substituent in addition to the coupler moiety represented by general formula (VII), (VIII), (IX), (X) or (XI). Preferred examples of the substituents include a hydrogen atom, a chlorine atom or a lower alkyl group having from 1 to 4 carbon atoms.

Examples of non-color-forming ethylenic monomers which do not undergo coupling with the oxidation product of an aromatic primary amine developing agent include acrylic acid and derivatives thereof such as acrylic acid, α-chloroacrylic acid, α-alkyl-substituted acrylic acid (e.g., methacrylic acid, etc.), etc., an ester or an amide derived from these acrylic acids (e.g., acrylamide, n-butylacrylamide, tert-butylacrylamide, diacetoneacrylamide, methacrylamide methyl acrylate, ethyl acrylate, n-propyl acrylate, n-butyl acrylate, tert-butyl acrylate, isobutyl acrylate, 2-ethylhexyl acrylate, n-octyl acrylate, lauryl acrylate, methyl methacrylate, ethyl methacrylate, n-butyl methacrylate, β-hydroxyethyl methacrylate, etc.), methylenebisacrylamide, a vinyl ester (e.g., vinyl acetate, vinyl propionate, vinyl laurate, etc.), acrylonitrile, methacrylonitrile, an aromatic vinyl compound (e.g., styrene and derivatives thereof, vinyltoluene, divinylbenzene, vinylacetophenone, sulfostyrene, etc.), itaconic acid, citraconic acid, crotonic acid, vinylidene chloride, a vinyl alkyl ether (e.g., vinyl ethyl ether, etc.), maleic acid, amleic anhydride, a maleic acid ester, N-vinyl-2-pyrrolidone, N-vinylpyridine, 2- or 4-vinylpyridine, etc.

Two or more non-color-forming ethylenically unsaturated monomers can be used together.

The group represented by X in general formula (VII), (VIII), (IX), (X) or (XI) is preferably a hydrogen atom, an arylthio group or an aryloxy group.

Specific examples of the pyrazoloazole type magenta couplers represented by general formulae (VII), (VIII), (IX), (X) and (XI) which can be used in the present invention and methods for synthesis thereof are described in the following literature.

The compounds of general formula (VII) are described in Japanese Patent Application (OPI) NO. 162548/84, etc., the compounds of general formula (VIII) are described in Japanese Patent Application (OPI) No. 43659/85, etc., the compounds of general formula (IX) are described in Japanese Patent Publication No. 27411/72, etc., the compounds of general formula (X) are described in Japanese Patent Application (OPI) Nos. 171956/84 and Japanese Patent Application No. 27745/84, etc., and the compounds of general formula (XI) are described in Japanese Patent Application (OPI) No. 33552/85, etc., respectively.

In addition, highly color-forming ballast groups as described, for example, in Japanese Patent Application (OPI) No. 42045/83, Japanese Patent Application No. 214854/84, 177553/84, 177553/84 and 177557/84, etc., can be applied to any of the compounds represented by general formula (VII), (VIII), (IX), (X) or (XI) described above.

The compound represented by general formula (I) and the compound represented by general formula (II) can be applied to a multilayer multicolor photographic material having layers sensitive to at least three different spectral wavelength ranges on a support for the main purpose of improving sharpness and improving color reproducibility. A multilayer natural color photographic material generally possesses at least one red-sensitive silver halide emulsion layer, at least one green-sensitive silver halide emulsion layer and at least one blue-sensitive silver halide emulsion layer, respectively, on a support. The order of these layers can be varied appropriately, if desired. Further, each of the compounds according to the present invention can be employed in an appropriate layer selected from a high-sensitive layer and a middle-sensitive layer, etc. Moreover, each of these compounds can be preferably employed in a green-sensitive silver halide emulsion layer or an adjacent layer thereto.

The amount of the compound represented by general formula (I) added according to the present invention may be varied depending on the structure of the compound to be used. However, it is preferred to employ in a range from $1\times10^{-7}$ to 0.5 mol, particularly from $1\times10^{-6}$ to $1\times10^{-1}$ mol, per mol of silver present in the same layer or an adjacent layer.

The amount of the compound represented by general formula (II) added according to the present invention may be varied depending on the structure of the compound to be used. However, it is preferred to employ in a range from $1\times10^{-6}$ to 1 mol, particularly from $1\times10^{-5}$ to 0.5 mol, per mol of silver present in the same layer or an adjacent layer.

The compound represented by general formula (I) and the compound represented by general formula (II) can be incorporated to use into the same layer or different layers. Preferably, the compound represented by general formula (I) and the compound represented by general formula (II) are incorporated to use in the same layer.

The compound represented by general formula (I) and the compound represented by general formula (II) can be employed in a molar ratio of the compound represented by general formula (I)/the compound represented by general formula (II) from 0.01/99.99 to 50/50, and preferably from 1/99 to 25/75.

Specific examples of the couplers which can be employed in the present invention are set forth below, but the present invention should not be construed as being limited thereto.

Specific examples of the compounds represented by general formula (I) are described below.

COMPOUNDS (1)-(47)

(1)

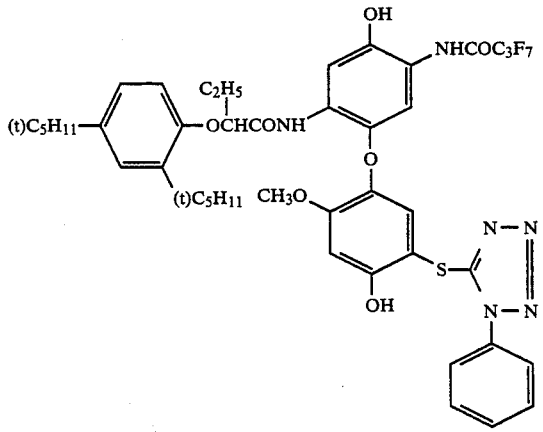

-continued
(2)
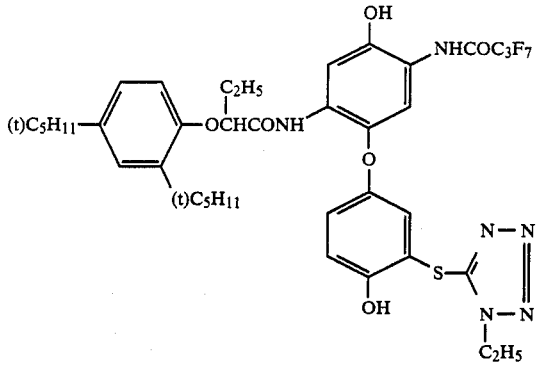
(3)
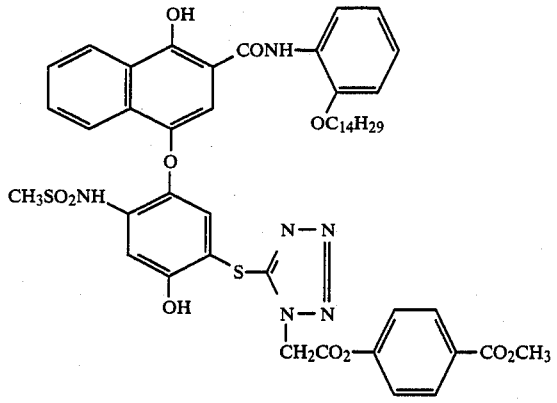
(4)
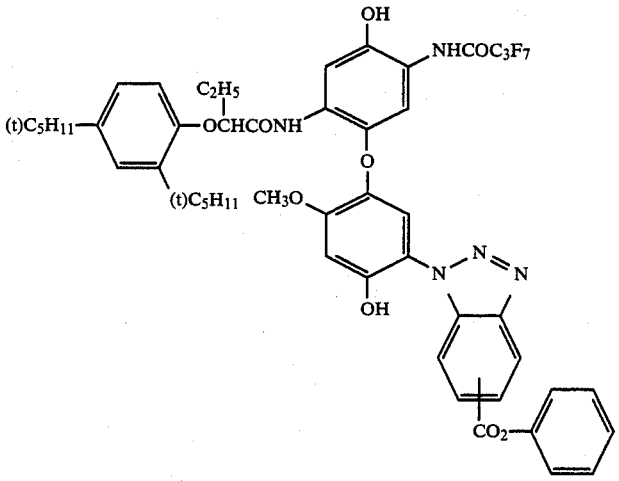
(5)
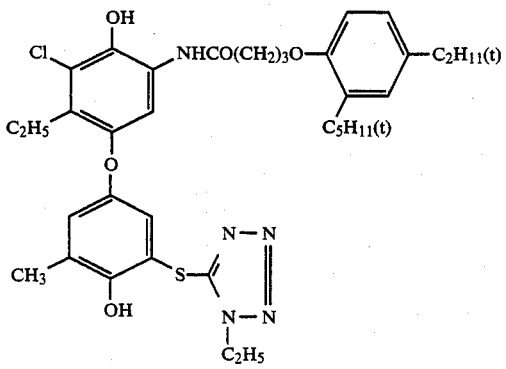

-continued
(6)
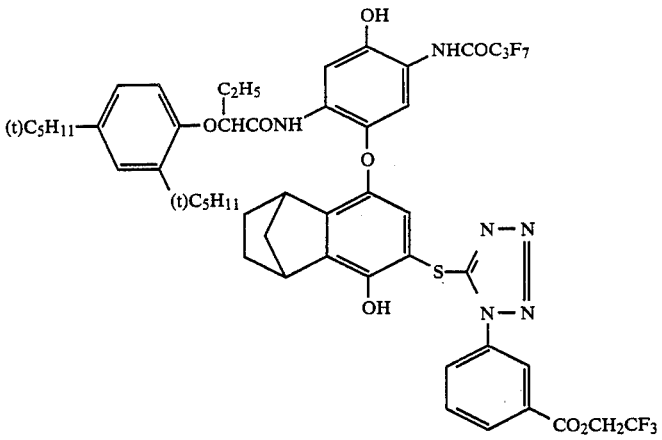
(7)
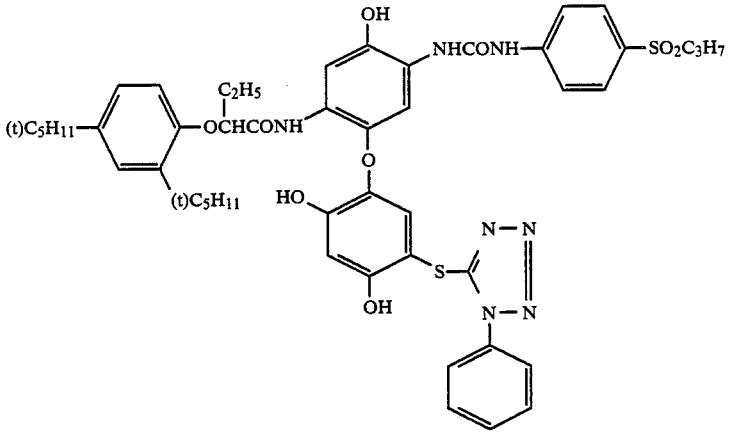
(8)
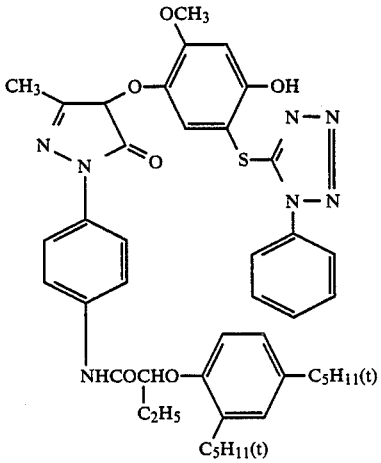

-continued
(9)
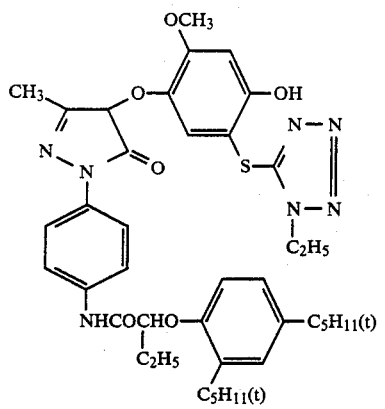
(10)
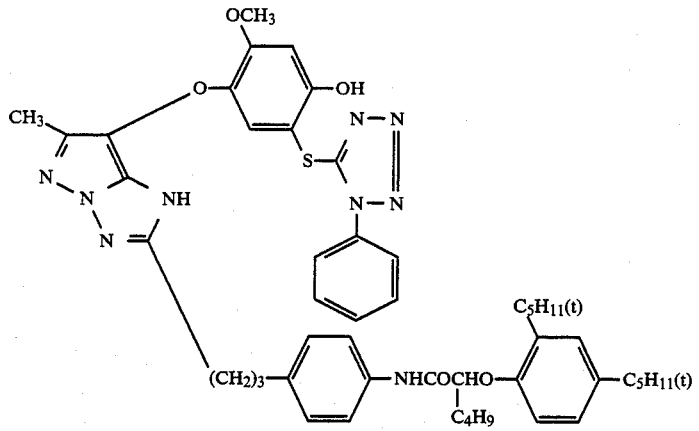
(11)
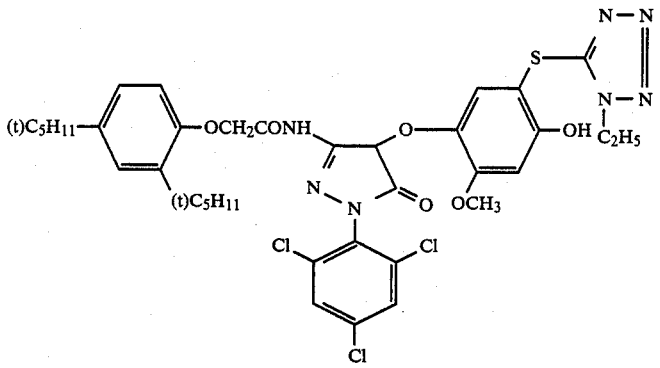
(12)
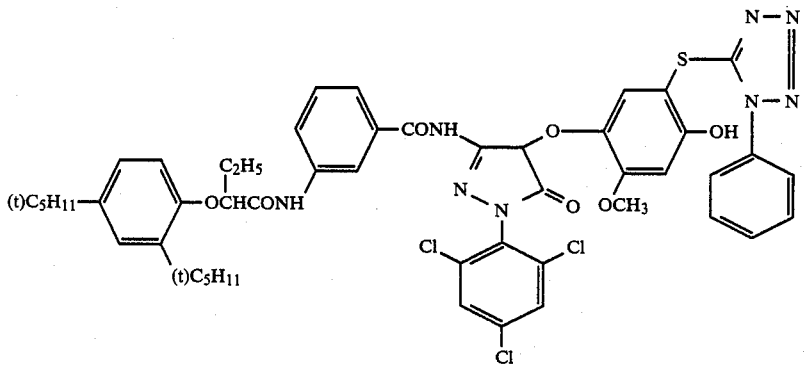

-continued
(13)
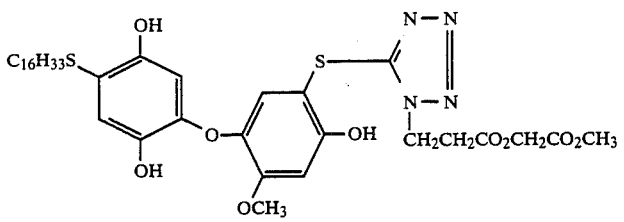
(14)
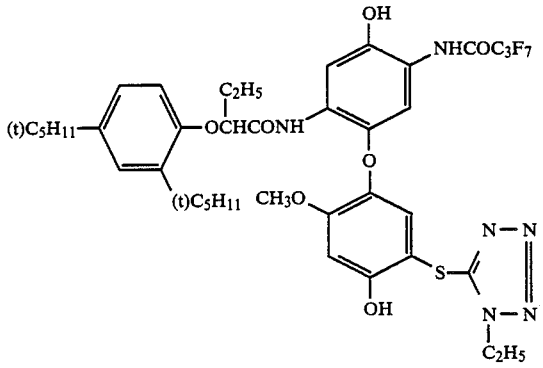
(15)
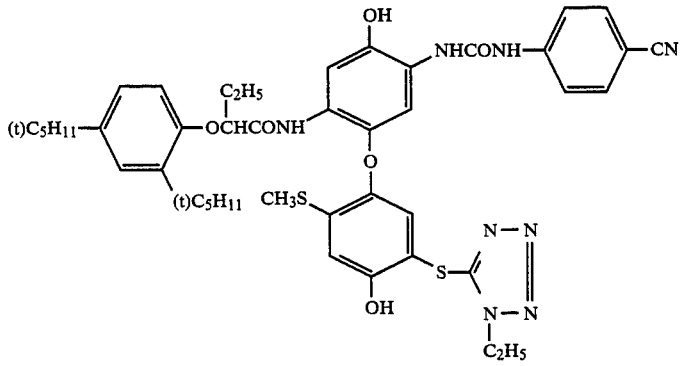
(16)
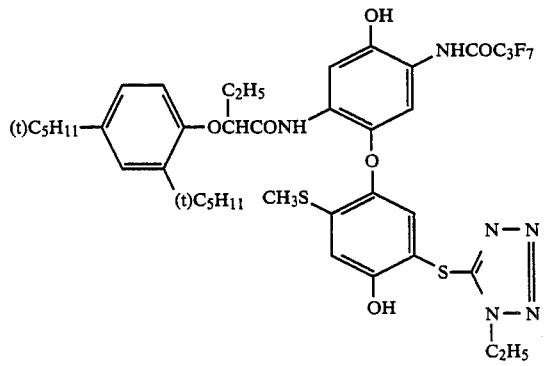

-continued
(17)
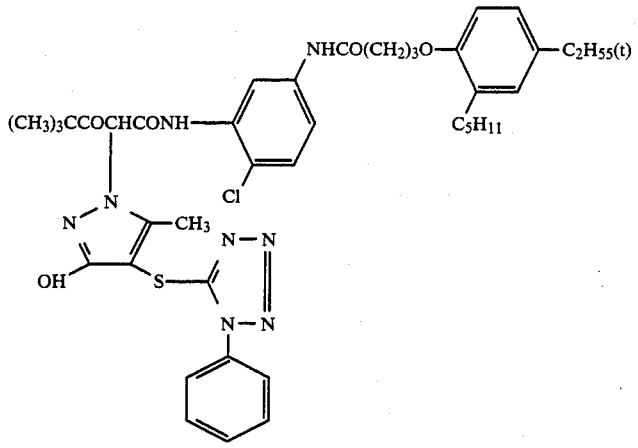
(18)
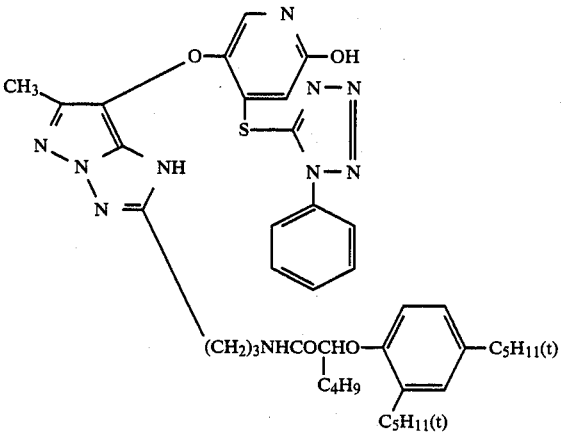
(19)
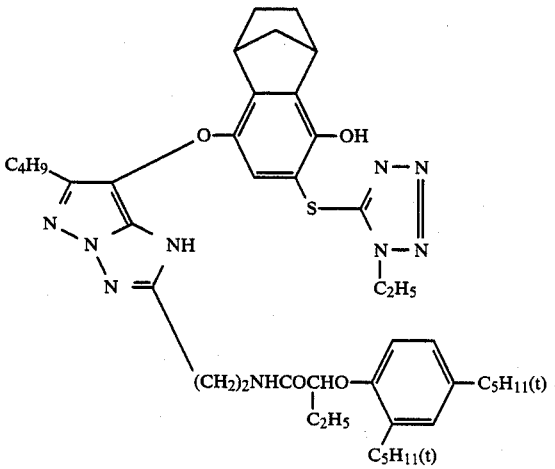

-continued
(20)
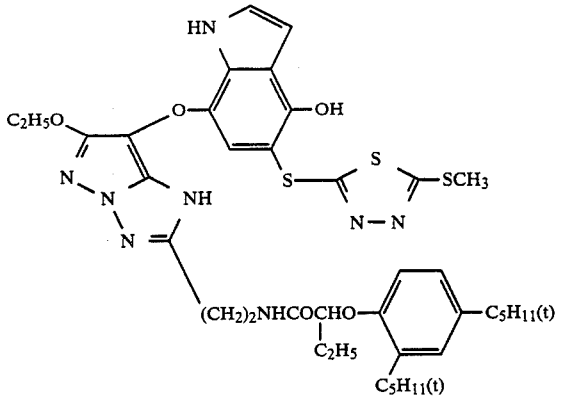
(21)
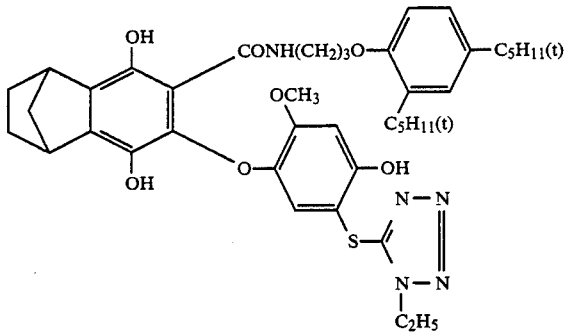
(22)
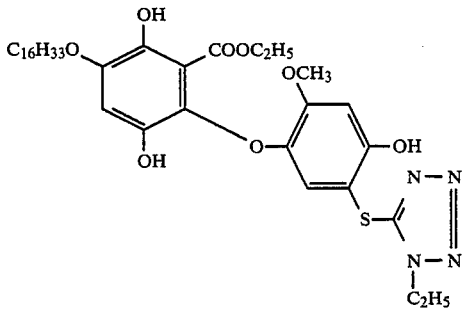
(23)
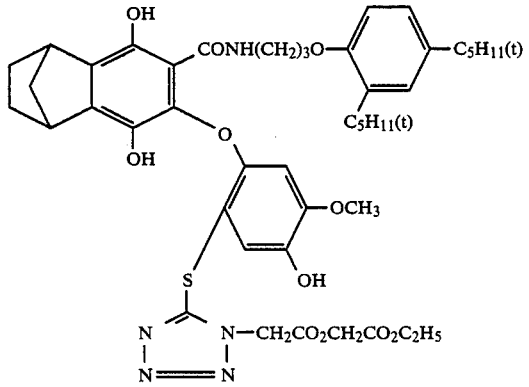

-continued
(24)
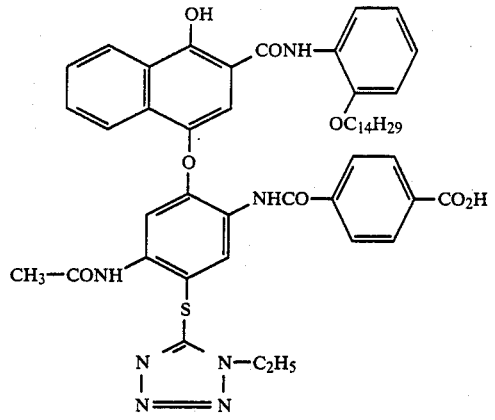
(25)
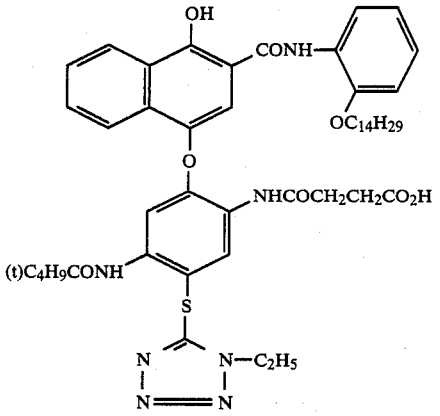
(26)
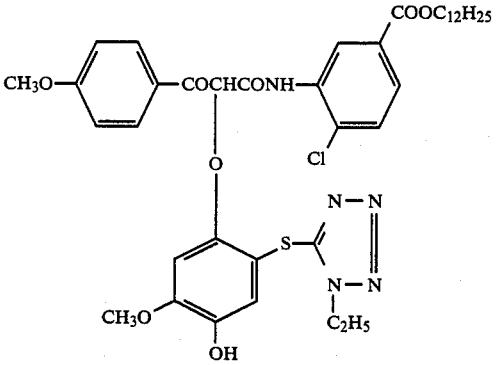
(27)
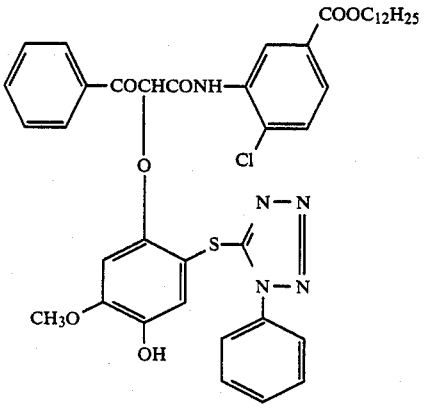

-continued
(28)
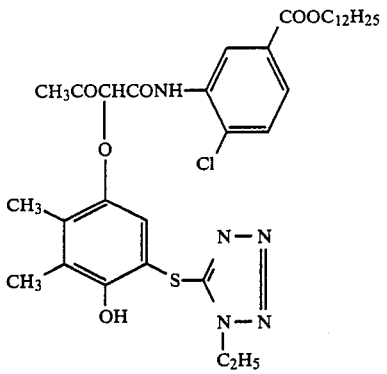
(29)
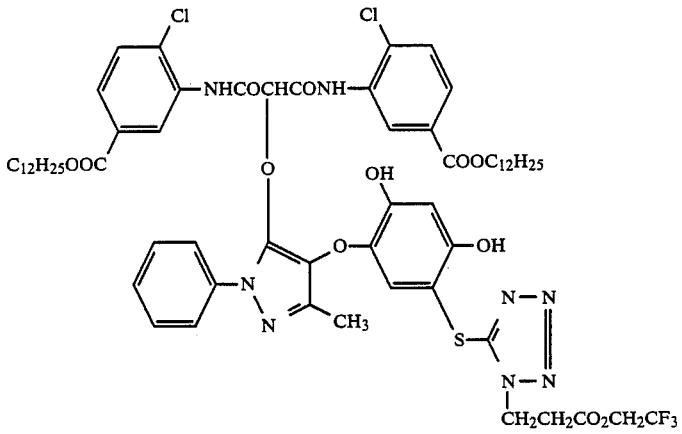
(30)
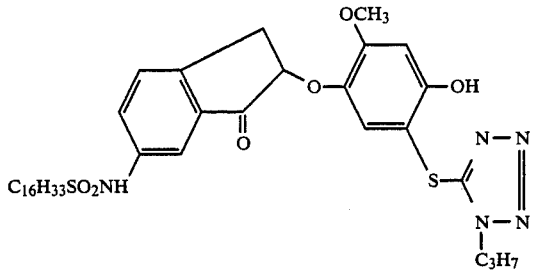
(31)
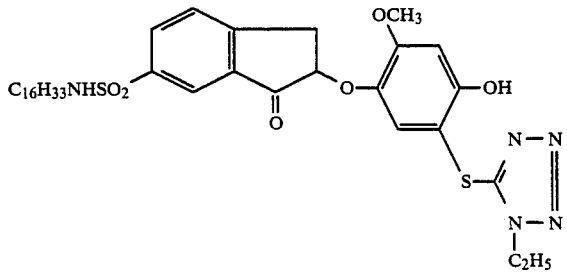

-continued
(32)
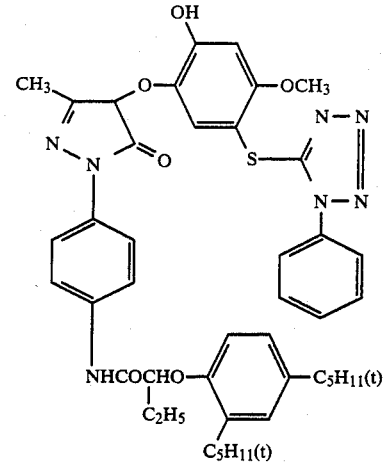
(33)
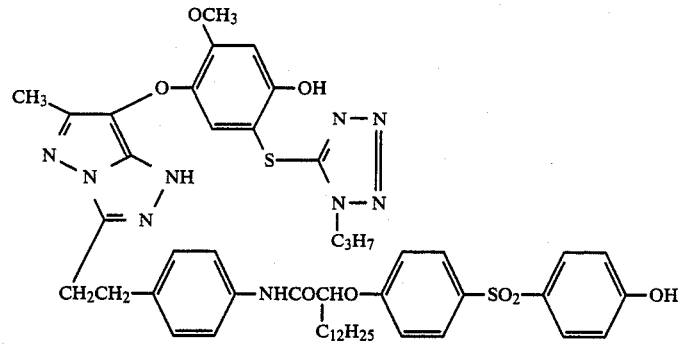
(34)
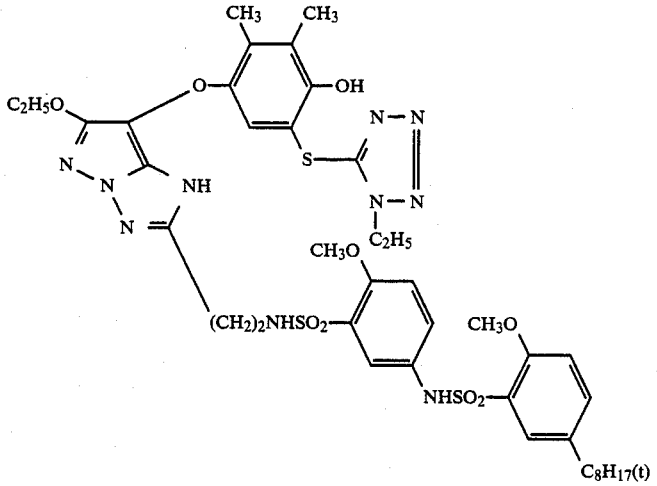
(35)
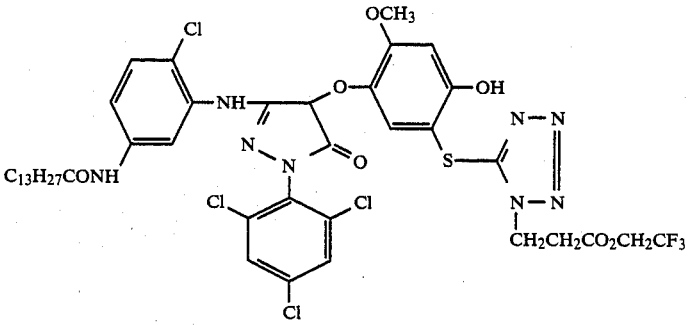

-continued
(36)
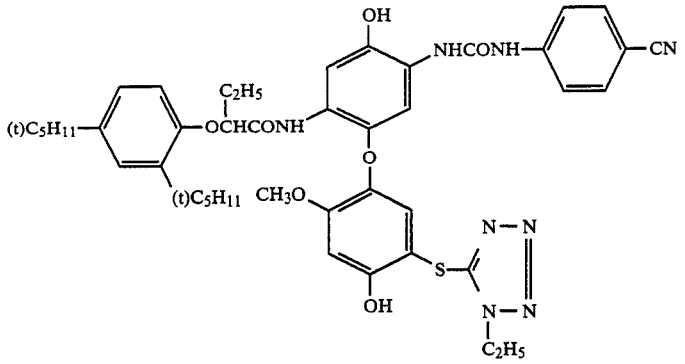
(37)
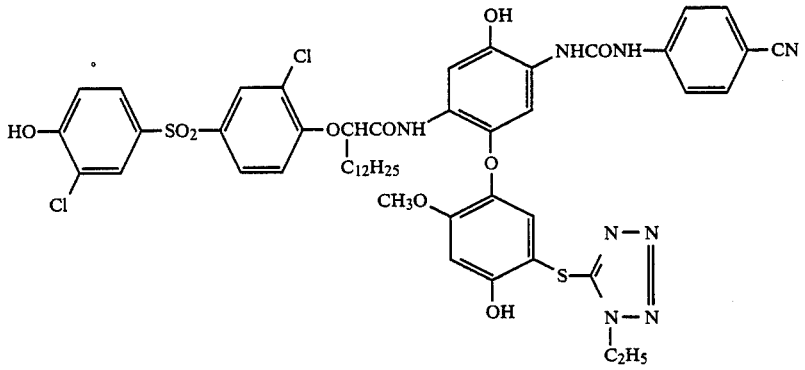
(38)
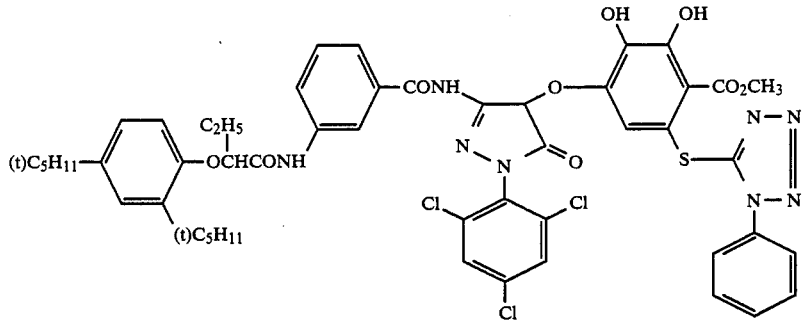
(39)
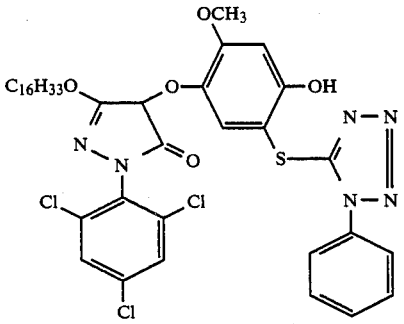

-continued
(40)
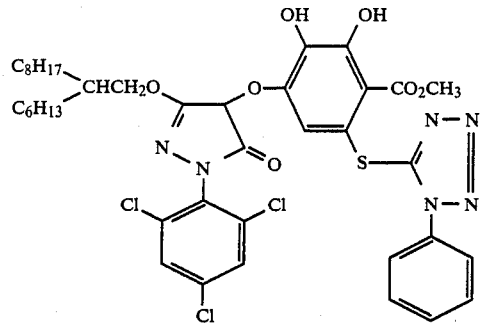
(41)
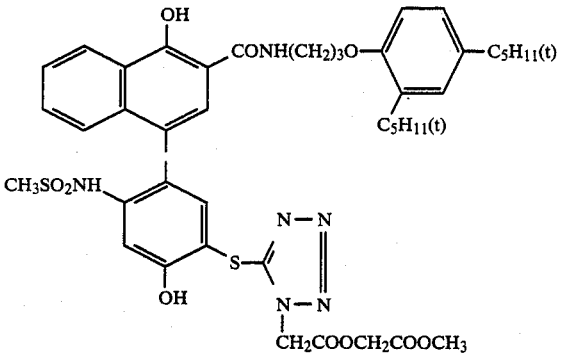
(42)
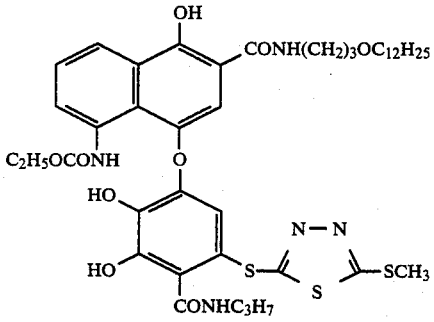
(43)
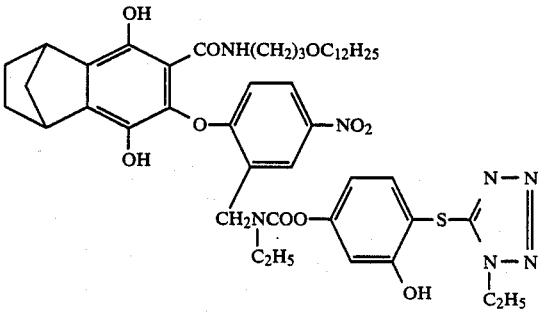

-continued
(44)
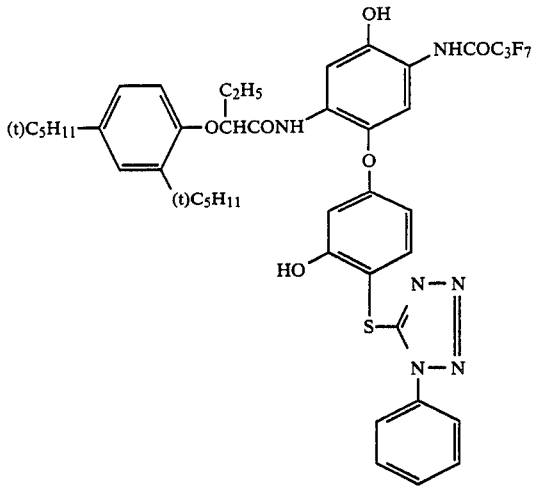
(45)
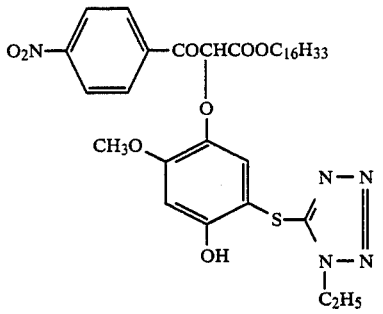
(46)
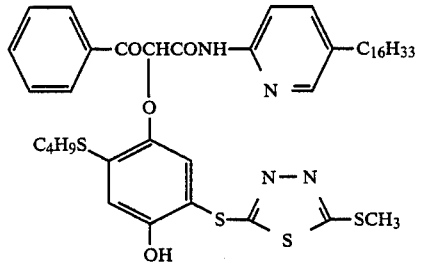
(47)
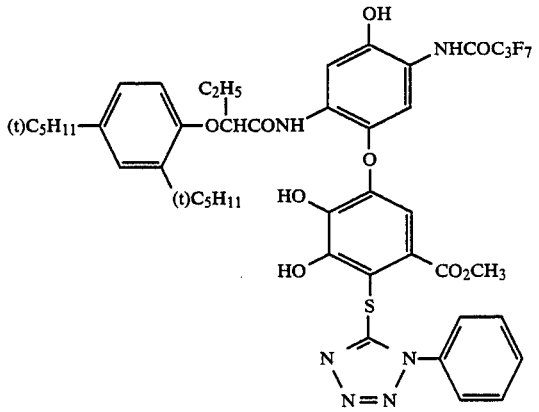
Preferred examples of the coupler monomers to prepare polymer couplers are described below.
COMPOUNDS (48)-(54)

(48)
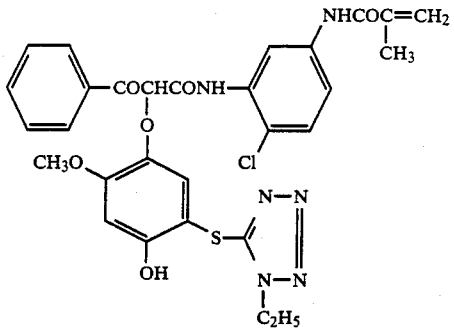
(49)
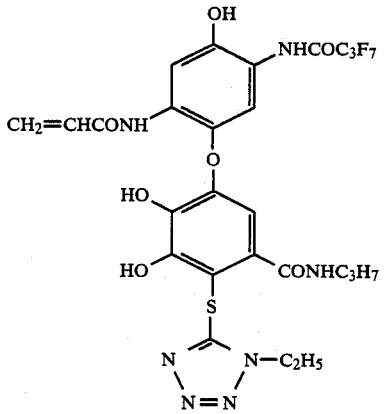
(50)
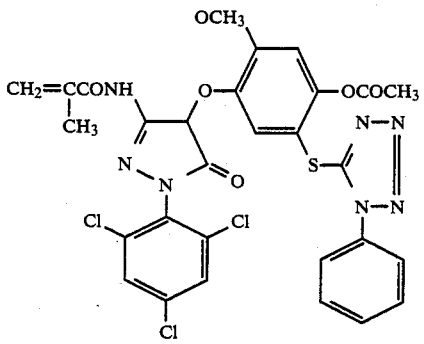
(51)
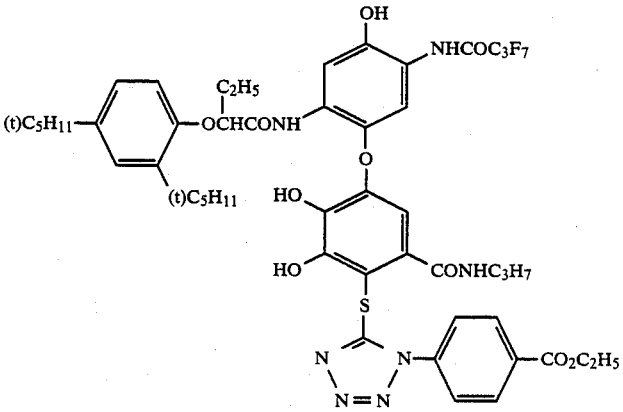

-continued
(52)
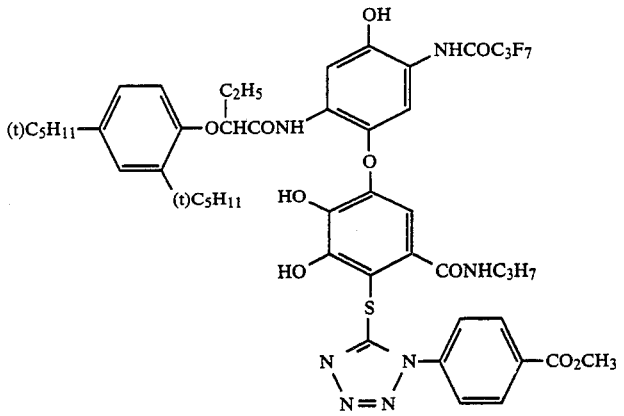
(53)
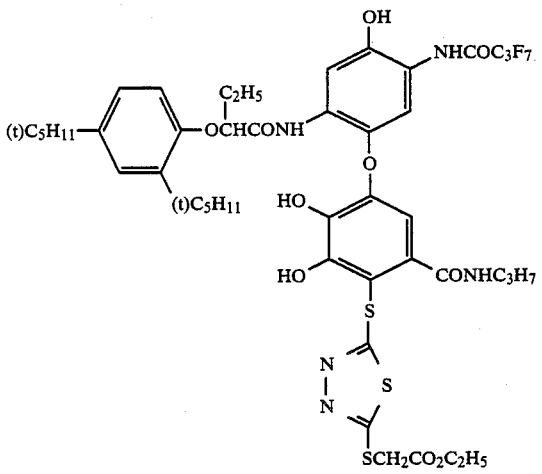
(54)
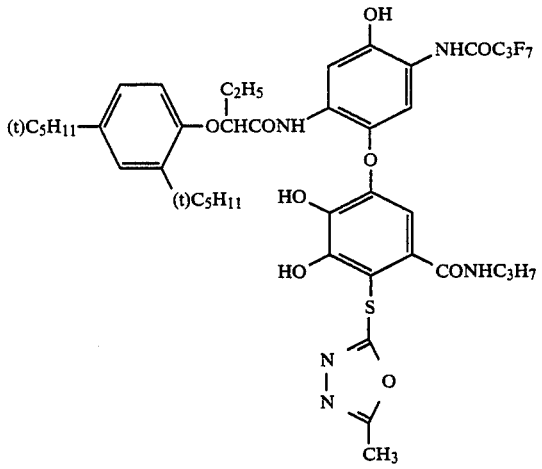
Specific examples of the couplers represented by general formula (II) are described below.
COMPOUNDS (55)–(69)

(55)
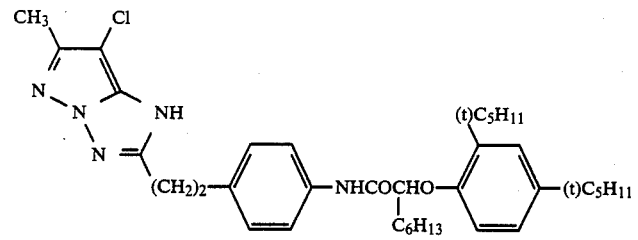
(56)
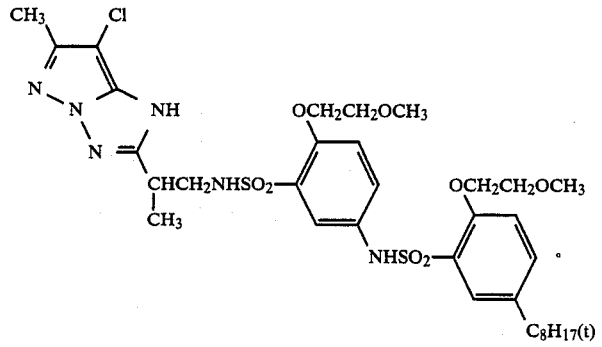
(57)
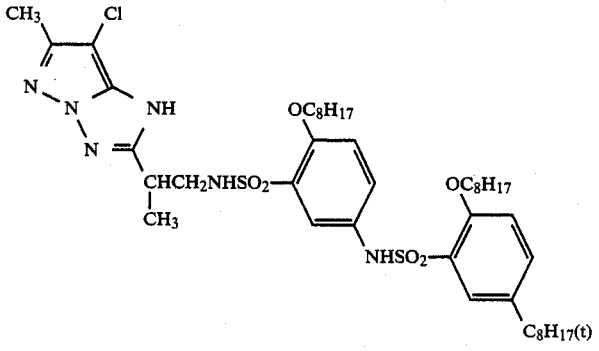
(58)
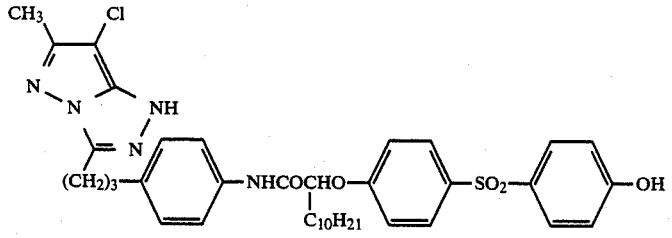
(59)
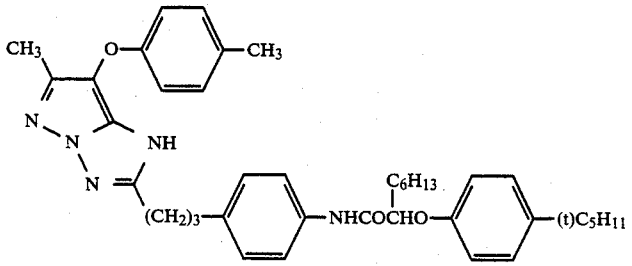

-continued
(60)
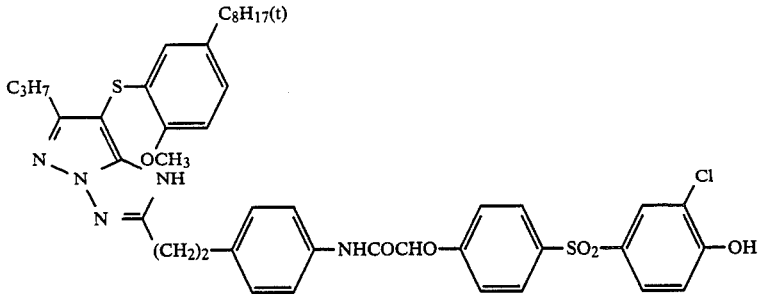
(61)
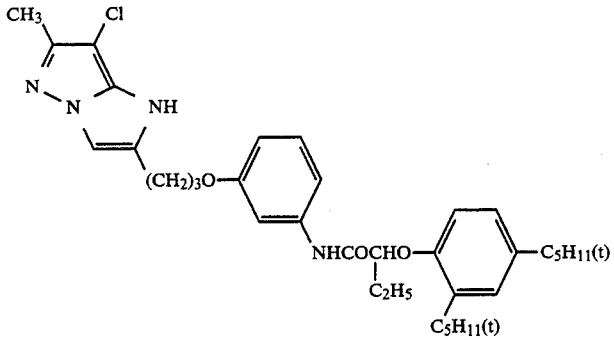
(62)
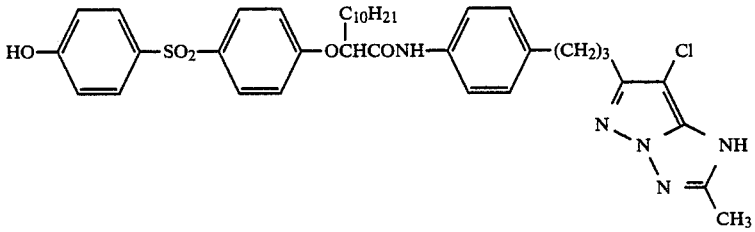
(63)
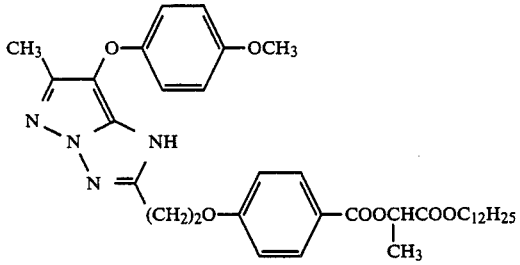
(64)
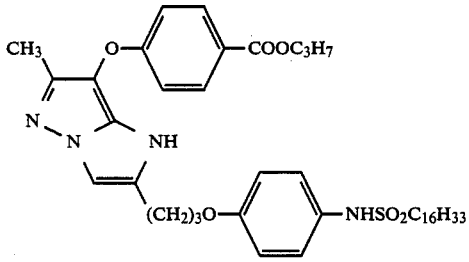
(65)
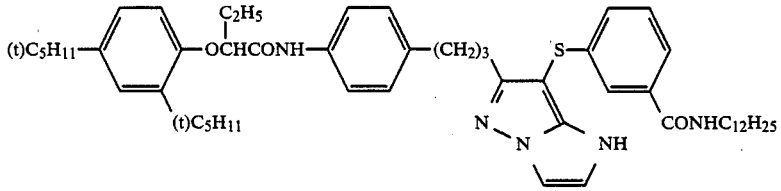

-continued
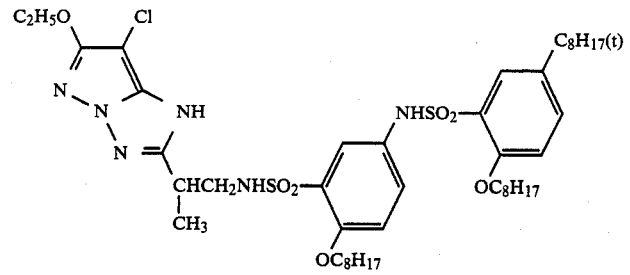
(66)
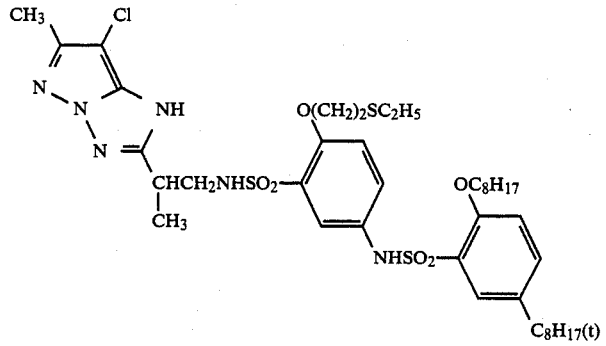
(67)
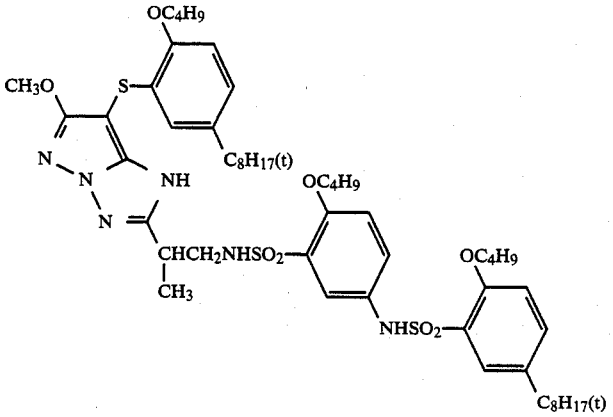
(68)
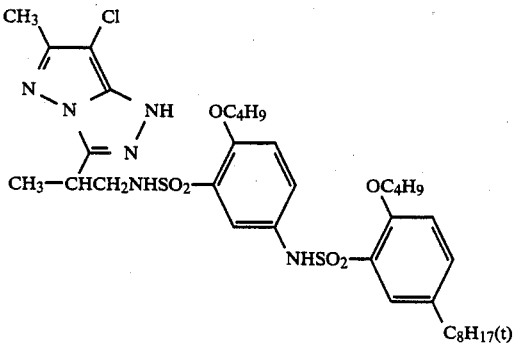
(69)
Preferred examples of the coupler monomers to prepare polymer couplers are described below.
COMPOUNDS (70)–(74)

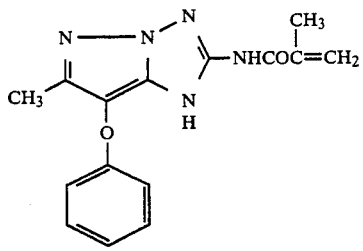

(70)

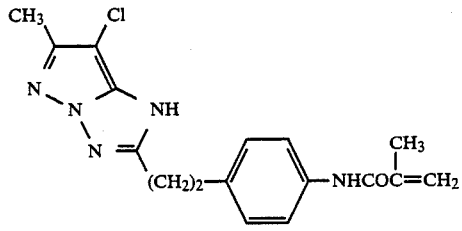

(71)

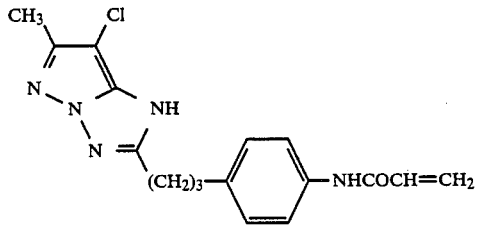

(72)

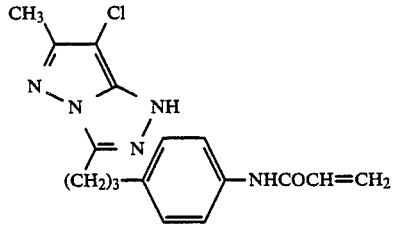

(73)

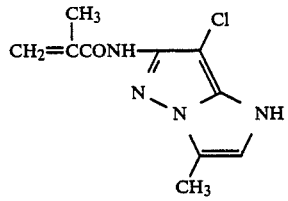

(74)

In the photographic emulsion layer used in the photographic light-sensitive material according to the present invention, any of silver bromide, silver iodobromide, silver iodochlorobromide, silver chlorobromide and silver chloride may be used as the silver halide. A preferred silver halide is silver iodobromide or silver iodochlorobromide each containing 30 mol% or less of silver iodide. Silver iodobromide containing from about 2 mol% to about 25 mol% of silver iodide is particularly preferred.

Silver halide grains in the photographic emulsion may have a regular crystal structure, for example, a cubic, octahedral or tetradecahedral structure, etc., an irregular crystal structure, for example, a spherical structure, etc., a crystal defect, for example, a twin plane, etc., or a composite structure thereof.

The grain size of silver halide may be varied and include from fine grains having about 0.1 micron or less to large size grains having about 10 microns of a diameter of projected area. Further, a monodispersed emulsion having a narrow grain size distribution and a polydispersed emulsion having a broad grain size distribution may be used.

The silver halide photographic emulsion used in the present invention can be prepared using known methods, for example, those as described in *Research Disclosure,* No. 17643 (December, 1978), pages 22 and 23, "I. Emulsion Preparation and Types" and ibid., No. 18716 (November, 1979), page 648, etc.

The photographic emulsion as used in the present invention can be prepared in any suitable manner, for example, by the methods as described in P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964). That is, any of an acid process, a neutral process, an ammonia process, etc., can be employed.

Soluble silver salts and soluble halogen salts can be reacted by techniques such as a single jet process, a double jet process, and a combination thereof. In addition, there can be employed a method (so-called reversal mixing process) in which silver halide particles are formed in the presence of an excess of silver ions.

As one system of the double jet process, a so-called controlled double jet process in which the pAg in a liquid phase where silver halide is formed is maintained at a predetermined level can be employed. This process can produce a silver halide emulsion in which the crystal form is regular and the grain size is nearly uniform.

Two or more kinds of silver halide emulsions which are prepared separately may be used as a mixture.

Silver halide emulsions composed of regular grains as described above can be obtained by controlling the pAg and pH during the step of formation of silver halide grains. The details thereof are described, for example, in Photographic Science and Engineering, Vol. 6, pages 159 to 165 (1962), Journal of Photographic Science, Vol. 12, pages 242 to 251 (1964), U.S. Pat. No. 3,655,394, and British Pat. No. 1,413,748, etc.

Representative monodispersed emulsions are those comprising silver halide grains having an average grain size of about 0.1 micron or more and at least about 95% by weight of the total silver halide grains having a size within the range of ±40% of the average grain size. In the present invention, it is preferred to employ a monodispersed emulsion comprising silver halide grains having an average grain size of from about 0.25 micron to about 2 microns and at least about 95% by weight or by number of particles of the total silver halide grains having a size within the range of ±20% of the average grain size. Methods for preparation of such monodispersed emulsions are described in U.S. Pat. Nos. 3,574,628 and 3,655,394, British Pat. No. 1,413,748, etc. Further, monodispersed emulsions as described in Japanese Patent Application (OPI) Nos. 8600/73, 39027/76, 83097/76, 137133/78, 48521/79, 99419/79, 37635/83 and 49938/83, etc., can be preferably employed in the present invention.

Further, tabular silver halide grains having an aspect ratio of about 5 or more can be employed in the present invention. The tabular grains may be easily prepared by the method as described in Gutoff, *Photographic Science and Engineering,* Vol. 14, pages 248 to 257 (1970), U.S. Pat. Nos. 4,434,226, 4,414,310, 4,433,048 and 4,439,520, British Pat. No. 2,112,157, etc. In the case of employing the tabular silver halide grains, it is described in detail that many advantages, for example, increase in spectral sensitizing efficiency with a sensitizing dye, improvement in graininess and improvement in sharpness, etc., are obtained in U.S. Pat. No. 4,434,226, etc., mentioned above.

The crystal structure of silver halide grains may be uniform, composed of different halide compositions between the inner portion and the outer portion, or may have a layer structure. Examples of such emulsion grains are described in British Pat. No. 1,027,146, U.S. Pat. Nos. 3,505,068 and 4,444,877, and Japanese Patent Application No. 248469/83, etc.

Further, silver halide emulsions in which silver halide grains having different compositions are connected upon epitaxial junctions or silver halide emulsions in which silver halide grains are connected with compounds other than silver halide, such as silver thiocyanate, lead oxide, etc., may also be employed. Examples of these emulsion grains are described in U.S. Pat. Nos. 4,094,684, 4,142,900 and 4,459,353, British Pat. No. 2,038,792, U.S. Pat. Nos. 4,349,622, 4,395,478, 4,433,501, 4,463,087, 3,656,962 and 3,852,067, Japanese Patent Application (OPI) No. 162540/84, etc.

Moreover, a mixture of grains having a different crystal structure may be used.

The photographic emulsions used in the present invention are usually conducted with physical ripening, chemical ripening and spectral sensitization. Various kinds of additives which can be employed in these steps are described in *Research Disclosure,* No. 17643 (December, 1978) and ibid., No. 18716 (November, 1979) as mentioned above and related items thereof are summarized in the table shown below.

Further, known photographic additives which can be used in the present invention are also described in the above-mentioned *Research Disclosures* and related items thereof are summarized in the table below.

| Kind of Additives | RD 17643 | RD 18716 |
|---|---|---|
| 1. Chemical Sensitizers | Page 23 | Page 648, right column |
| 2. Sensitivity Increasing Agents | | Page 648, right column |
| 3. Spectral Sensitizers and Supersensitizers | Pages 23 and 24 | Page 648, right column to page 649, right column |
| 4. Whitening Agents | Page 24 | — |
| 5. Antifoggants and Stabilizers | Pages 24 and 25 | Page 649, right column |
| 6. Light Absorbers, Filter Dyes and Ultraviolet Ray Absorbers | Pages 25 and 26 | Page 649, right column to page 650, left column |
| 7. Antistain Agents | Page 25, right column | Page 650, left column to right column |
| 8. Dye Image Stabilizers | Page 25 | — |
| 9. Hardeners | Page 26 | Page 651, left column |
| 10. Binders | Page 26 | Page 651, left column |
| 11. Plasticizers and Lubricants | Page 27 | Page 650, right column |
| 12. Coating Aids and Surfactants | Pages 26 and 27 | Page 650, right column |
| 13. Antistatic Agents | Page 27 | Page 650, right column |

In the present invention, various color couplers can be employed. Specific examples of such couplers are described in the patents cited in *Research Disclosure,* No. 17643, "VII-C" to "VII-G" as mentioned above. As dye-forming couplers, couplers capable of providing three primary colors (i.e., yellow, magenta and cyan) in the subtractive process upon color development are important. Specific examples of preferred diffusion resistant 4-equivalent or 2-equivalent couplers are described in the patents cited in *Research Disclosure,* No. 17643, "VII-C" and "VII-D" as mentioned above. In addition, couplers as described below are preferably employed in the present invention.

As typical yellow couplers used in the present invention, hydrophobic acylacetamide type couplers having a ballast group are exemplified. Specific examples thereof are described in U.S. Pat. Nos. 2,407,210, 2,875,057 and 3,265,506, etc. In the present invention 2-equivalent yellow couplers are preferably employed.

Typical examples of 2-equivalent yellow couplers include yellow couplers of oxygen atom-releasing type as described in U.S. Pat. Nos. 3,408,194, 3,447,928, 3,933,501 and 4,022,620, etc., and yellow couplers of nitrogen atom-releasing type as described in Japanese Patent Publication No. 10739/83, U.S. Pat. Nos. 4,401,752 and 4,326,024, *Research Disclosure,* No. 18053 (April, 1979), British Pat. No. 1,425,020, West German Patent Application (OLS) Nos. 2,219,917, 2,261,361, 2,329,587 and 2,433,812, etc. α-Pivaloylacetanilide type couplers are characterized by fastness, particularly light fastness, of dyes formed, and α-benzoylacetanilide type couplers are characterized in that they provide a high color density.

As magenta couplers used in the present invention, hydrophobic indazolone type couplers, cyanoacetyl type couplers, and preferably 5-pyrazolone type couplers and pyrazoloazole type couplers each having a ballast group are exemplified. Of 5-pyrazolone type couplers, those substituted with an arylamino group or an acylamino group at the 3-position thereof are preferred in view of hue and color density of dyes formed. Typical examples thereof are described in U.S. Pat. Nos. 2,311,082, 2,343,703, 2,600,788, 2,908,573, 3,062,653, 3,152,896 and 3,936,015, etc. As releasing groups for 2-equivalent 5-pyrazolone type couplers, nitrogen atom releasing groups as described in U.S. Pat. No. 4,310,619 and arylthio groups as described in U.S. Pat. No. 4,351,897 and particularly preferred. Further, 5-pyrazolone type couplers having a ballast group as described in European Pat. No. 73,636 are advantageous since they provide a high color density.

Examples of pyrazoloazole type couplers include pyrazolobenzimidazoles as described in U.S. Pat. No. 3,369,879, and preferably pyrazolo[5,1-c][1,2,4]triazoles as described in U.S. Pat. No. 3,725,067, pyrazolotetrazoles as described in *Research Disclosure,* No. 24220 (June, 1984) and Japanese Patent Application (OPI) No. 33552/85 and pyrazolopyrazoles as described in *Research Disclosure,* No. 24230 (June, 1984) and Japanese Patent Application (OPI) No. 43659/85. Imidazo[1,2-b]pyrazoles as described in U.S. Pat. No. 4,500,630 are preferred and pyrazolo[1,5-b][1,2,4]triazoles as described in U.S. Pat. No. 4,540,654 are particularly preferred in view of less yellow subsidiary absorption and light fastness of dyes formed.

As cyan couplers used in the present invention, hydrophobic and diffusion resistant naphthol type and phenol type couplers are exemplified. Typical examples thereof include naphthol type couplers as described in U.S. Pat. No. 2,474,293 and preferably oxygen atom-releasing type 2-equivalent naphthol type couplers as described in U.S. Pat. Nos. 4,052,212, 4,146,396, 4,228,233 and 4,296,200, etc. Specific examples of phenol type couplers are described in U.S. Pat. Nos. 2,369,929, 2,801,171, 2,772,162 and 2,895,826, etc.

Cyan couplers fast to humidity and temperature are preferably used in the present invention. Typical examples thereof include phenol type cyan couplers having an alkyl group more than an ethyl group at the meta-position of the phenol nucleus as described in U.S. Pat. No. 3,772,002, 2,5-diacylamino-substituted phenol type couplers as described in U.S. Pat. Nos. 2,772,162, 3,758,308, 4,126,396, 4,334,011 and 4,327,173, West German Patent Application (OLS) No. 3,329,729, and European Pat. No. 121,365, etc., and phenol type couplers having a phenylureido group at the 2-position thereof and an acylamino group at the 5-position thereof as described in U.S. Pat. Nos. 3,446,622, 4,333,999, 4,451,559 and 4,427,767, etc., and 5-aminonaphthol type couplers as described in European Pat. No. 161,626A, etc.

It is preferred to conduct masking by using colored couplers together in color photographic light-sensitive materials for photographing in order to correct undesirable absorptions of dyes formed. Typical examples of colored couplers include yellow-colored magenta couplers as described in U.S. Pat. No. 4,163,670 and Japanese Patent Publication No. 39413/82, etc., and magenta-colored cyan couplers as described in U.S. Pat. Nos. 4,004,929 and 4,138,258 and British Pat. No. 1,146,368, etc. Other examples of useful colored couplers are described in *Research Disclosure,* No. 17643, "VII-G" as mentioned above.

Further, couplers capable of forming appropriately diffusible dyes can be used together in order to improve graininess. Specific examples of such types of magenta couplers are described in U.S. Pat. No. 4,366,237 and British Pat. No. 2,125,570, etc., and those of yellow, magenta and cyan couplers are described in European Pat. No. 96,570 and West German Patent Application (OLS) No. 3,234,533, etc.

Dye-forming couplers and the above-described special couplers may form polymers including dimers or more. Typical examples of polymerized dye-forming couplers are described in U.S. Pat. Nos. 3,451,820 and 4,080,211, etc. Specific examples of polymerized magenta couplers are described in British Pat. No. 2,102,173 and U.S. Pat. No. 4,367,282, etc.

Couplers capable of releasing a photographically useful residue during the course of coupling can be also employed preferably in the present invention. Specific examples of useful DIR couplers capable of releasing a development inhibitor are described in the patents cited in *Research Disclosure,* No. 17643, "VII-F" mentioned above.

Of DIR couplers, those of deactivation type in a developing solution as represented by Japanese Patent Application (OPI) No. 151944/82, those of timing type as represented by U.S. Pat. No. 4,248,962 and Japanese Patent Application (OPI) No. 154234/82 and those of reactive type as represented by Japanese Patent Application (OPI) No. 184248/85 are preferred to employ them in combination with the present invention. Further, DIR couplers of deactivation type in a developing solution as described in Japanese patent application (OPI) Nos. 151944/82, 217932/83, 218644/85, 225156/85 and 233650/85, etc., and DIR couplers of reactive type as described in Japanese patent application (OPI) No. 184248/85, etc., are particularly preferred.

In the photographic light-sensitive material of the present invention, couplers which release imagewise a nucleating agent, a development accelerator or a precursor thereof at the time of development can be employed. Specific examples of such compounds are described in British Pat. Nos. 2,097,140 and 2,131,188, etc. Couplers which release a nucleating agent having an adsorption function to silver halide are particularly preferred, and specific examples thereof are described in Japanese patent application (OPI) Nos. 157638/84 and 170840/84, etc.

Suitable supports which can be used in the present invention are described, for example, in *Research Disclosure,* No. 17643, page 28 and ibid., No. 18716, page 647, right column to page 648, left column, as mentioned above.

The color photographic light-sensitive material according to the present invention can be subjected to development processing in a conventional manner as described in *Research Disclosure,* No. 17643, pages 28 and 29 and ibid., No. 18716, page 651, left column to right column.

After a development, bleach-fixing or fixing step, the color photographic light-sensitive material according to the present invention is usually subjected to a water washing process or a stabilizing process.

The water washing step is generally conducted by a countercurrent water washing step using two or more tanks in order to reduce an amount of water used. As for stabilizing processing, a multistage countercurrent stabilizing process as described in Japanese patent application (OPI) No. 8543/82 is exemplary of what can be employed in place of the water washing step. In this step two to nine tanks for the countercurrent bath are necessary. To the stabilizing bath various kinds of compounds are added for the purpose of stabilizing the images formed. Representative examples of the additives include various buffers (for example, borates, metaborates, borax, phosphates, carbonates, potassium hydroxide, sodium hydroxide, aqueous ammonia, monocarboxylic acids, dicarboxylic acids, polycarboxylic acids, etc., being used in combination) for the purpose of adjusting pH of layers (for example, pH of 3 to 8), and a formalin, etc. In addition, various additives, for example, water softeners (for example, inorganic phosphoric acids, aminopolycarboxylic acids, organic phosphoric acids, aminopolyphosphonic acids, phosphonocarboxylic acids, etc.), sterilizers (for example, benzoisothiazolinones, isothiazolones, 4-thiazolinebenzimidazoles, halogenated phenols, etc.), surface active agenst, fluorescent whitening agents, hardeners, etc., may be employed, if desired. Two or more kinds of compounds for the same or different purposes may be employed together.

Further, it is preferred to add various ammonium salts such as ammonium chloride, ammonium nitrate, ammonium sulfate, ammonium phosphate, ammonium sulfite, ammonium thiosulfate, etc., as a pH adjusting agent for the layers after development processing.

The present invention can be applied to various color photographic light-sensitive materials. Representative examples include color negative films for general use or movies, color reversal films for slides or television, color paper, color positive films and color reversal paper, etc. The present invention may also be applied to black and white photographic light-sensitive materials utilizing a mixture of three color couplers as described in *Research Disclosure,* No. 17123 (July, 1978), etc.

The present invention will now be illustrated in greater detail with reference to the following examples, but it should be understood that these examples are not intended to limit the scope of the present invention. Unless otherwise indicated, all parts, percents and ratios are by weight.

EXAMPLE 1

On a polyethylene terephthalate film support were coated layers having the compositions set forth below to prepare a multilayer color photographic light-sensitive material.

First Layer: Antihalation Layer
A gelatin layer containing black colloidal silver
Black Colloidal Silver: 0.18 g/m$^2$
Gelatin: 0.6 g/m$^2$
Second Layer: Intermediate Layer
A gelatin layer containing a dispersion of 2,5-di-tert-octylhydroquinone
2,5-Di-Tert-Octylhydroquinone: 0.2 g/m$^2$
Gelatin: 0.5 g/m$^2$
Third Layer: First Red-Sensitive Emulsion Layer
A silver iodobromide emulsion (iodide content: 5 mol%), silver coated amount: 1.6 g/m$^2$
Gelatin: 1.8 g/m$^2$
Sensitizing Dye I: $4.5\times10^{-4}$ mol per mol of silver
Sensitizing Dye II: $1.5\times10^{-4}$ mol per mol of silver
Coupler EX-1: 0.03 mol per mol of silver
Coupler EX-3: 0.003 mol per mol of silver
Coupler EX-9: 0.002 mol per mol of silver
Fourth Layer: Second Red-Sensitive Emulsion Layer
A silver iodobromide emulsion (iodide content: 10 mol%), silver coated amount: 1.4 g/m$^2$
Gelatin: 1.3 g/m$^2$
Sensitizing Dye I: $3\times10^{-4}$ mol per mol of silver
Sensitizing Dye II: $1\times10^{-4}$ mol per mol of silver
Coupler EX-1: 0.002 mol per mol of silver
Coupler EX-2: 0.02 mol per mol of silver
Coupler EX-3: 0.0016 mol per mol of silver
Fifth Layer: Intermediate Layer
Same as the Second Layer
Sixth Layer: First Green-Sensitive Emulsion Layer
A silver iodobromide emulsion (iodide content: 6 mol%), silver coated amount: 1.8 g/m$^2$
Gelatin: 1.5 g/m$^2$
Sensitizing Dye III: $5\times10^{-4}$ mol per mol of silver
Sensitizing Dye IV: $2\times10^{-4}$ mol per mol of silver
Coupler EX-4: 0.05 mol per mol of silver
Coupler EX-5: 0.008 mol per mol of silver
Coupler EX-9: 0.003 mol per mol of silver
Seventh Layer: Second Green-Sensitive Emulsion Layer
A silver iodobromide emulsion (iodide content: 8 mol%), silver coated amount: 1.3 g/m$^2$
Gelatin: 1.0 g/m$^2$
Sensitizing Dye III: $3\times10^{-4}$ mol per mol of silver
Sensitizing Dye IV: $1.2\times10^{-4}$ mol per mol of silver
Coupler EX-7: 0.017 mol per mol of silver
Coupler EX-6: 0.003 mol per mol of silver
Eighth Layer: Yellow Filter Layer
A gelatin layer containing yellow colloidal silver and a dispersion of 2,5-di-tert-octylhydroquinone
Yellow Colloidal Silver: 0.07 g/m$^2$
2,5-Tert-Octylhydroquinone: 0.08 g/m$^2$
Gelatin: 0.8 g/m$^2$
Ninth Layer: First Blue-Sensitive Emulsion Layer
A silver iodobromide emulsion (iodide content: 6 mol%), silver coated amount: 0.7 g/m$^2$
Gelatin: 1.5 g/m$^2$
Coupler EX-8: 0.25 mol per mol of silver
Coupler EX-14: 0.010 mol per mol of silver
Tenth Layer: Second Blue-Sensitive Emulsion Layer
A silver iodobromide emulsion (iodide content: 6 mol%), silver coated amount: 0.6 g/m$^2$
Gelatin: 0.9 g/m$^2$
Coupler EX-8: 0.06 mol per mol of silver
Eleventh Layer: First Protective Layer
A gelatin layer containing silver iodobromide (iodide content: 1 mol%, average particle size: 0.07 μm, silver coated amount: 0.5 g/m$^2$) and a dispersion of Ultraviolet Ray Absorbing Agent UV-1.
Ultraviolet Ray Absorbing Agent UV-1: 0.3 g/m$^2$
Gelatin: 1.0 g/m$^2$
Twelfth Layer: Second Protective Layer
A gelatin layer containing polymethyl methacrylate particles (having a diameter of about 1.5 μm)
Polymethyl Methacrylate: 0.05 g/m$^2$
Gelatin: 0.8 g/m$^2$ Gelatin Hardener H-1 and a surface active agent were incorporated into each of the layers in addition to the above-described components.

Gelatin Hardener H-1: 0.4 g/m$^2$

The sample thus-prepared was designated Sample 101.

Samples 102 to 111 were prepared in the same manner as described for Sample 101 except changing Coupler EX-9 used in the first red-sensitive emulsion layer and the first green-sensitive emulsion layer to the compounds as shown in Table 1 below, respectively.

The structures of the compounds used for preparing these samples are as follows:

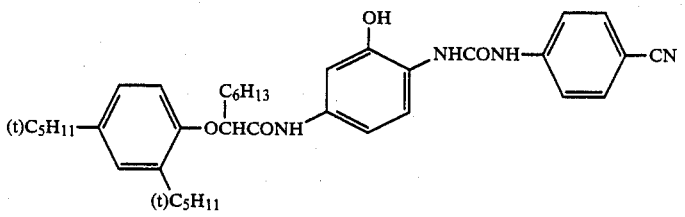

Coupler EX-1

-continued
Coupler EX-2
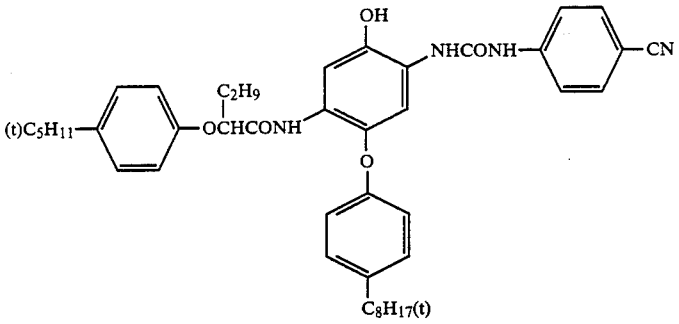
Coupler EX-3
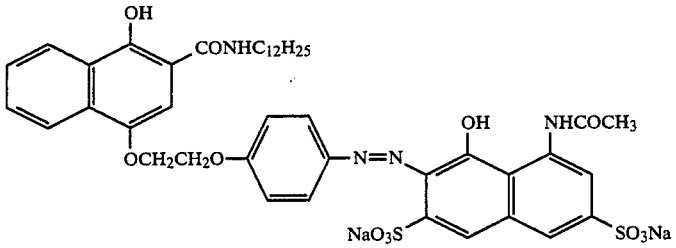
Coupler EX-4
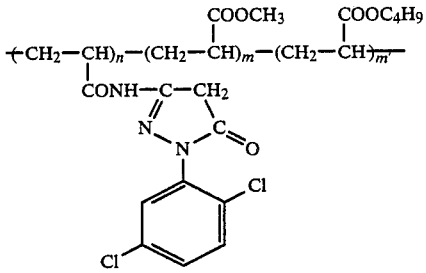
n/m + m' = 1 (wt. ratio)
m/m' = 1 (wt. ratio)
Molecular Weight: about 40,000
Coupler EX-5
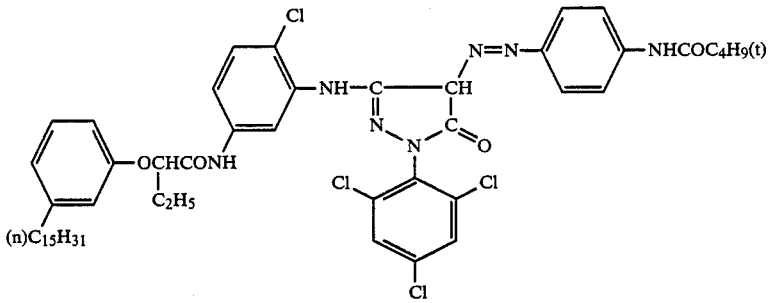
Coupler EX-6
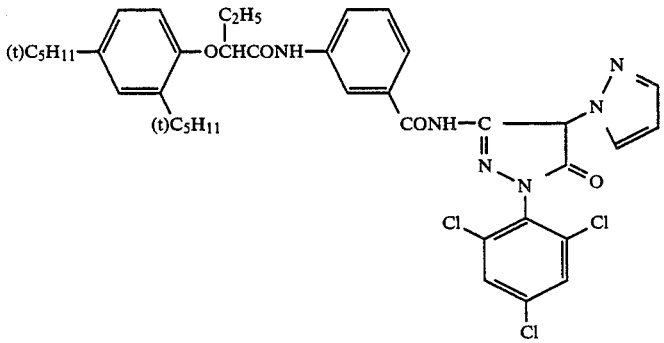

-continued
Coupler EX-5
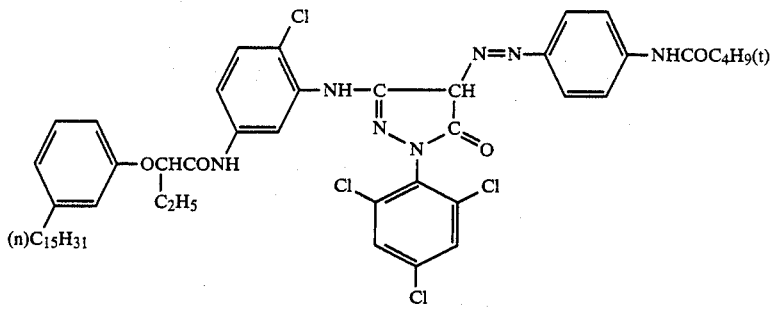
Coupler EX-6
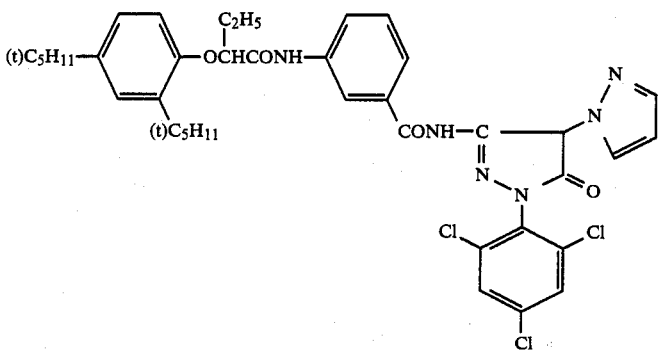
Coupler EX-7
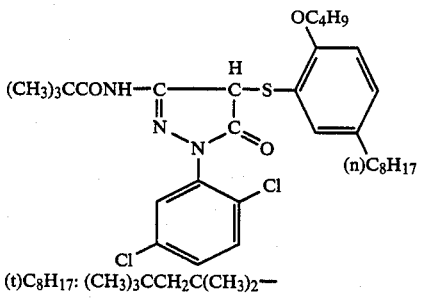
Coupler EX-8
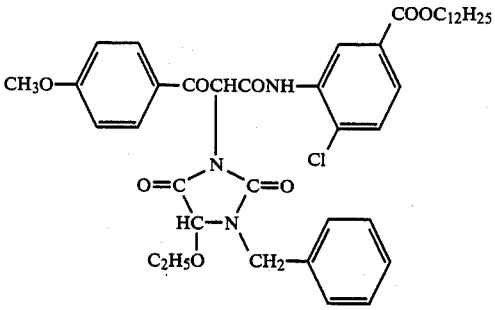
Coupler EX-9
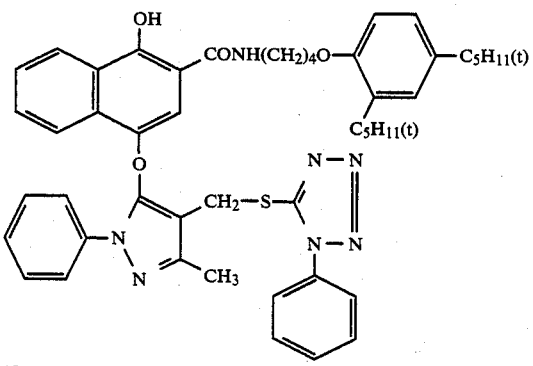
(Compound described in U.S. Pat. No. 4,421,845)

-continued
Compound EX-10
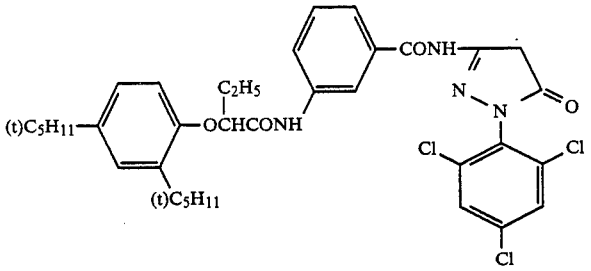
(Conventional Type Magenta Coupler)
Coupler EX-11
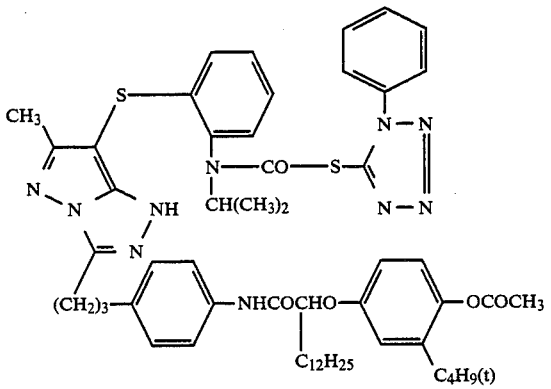
(Compound described in U.S. Pat. No. 4,248,962)
Coupler EX-12
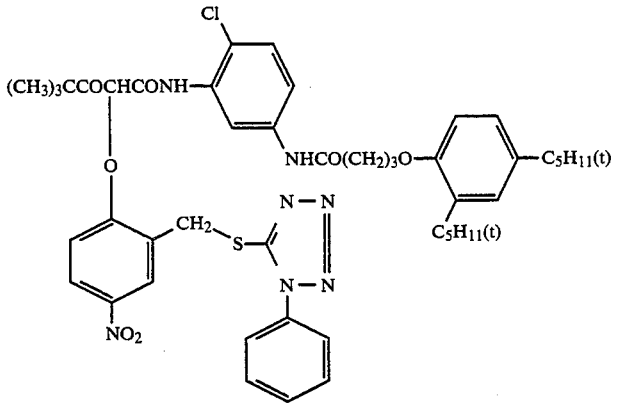
(Compound described in U.S. Pat. No. 4,409,323)
Coupler EX-13
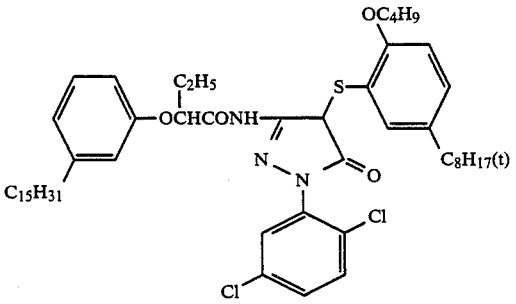
(Conventional Type Magenta Coupler)

-continued

Coupler EX-14

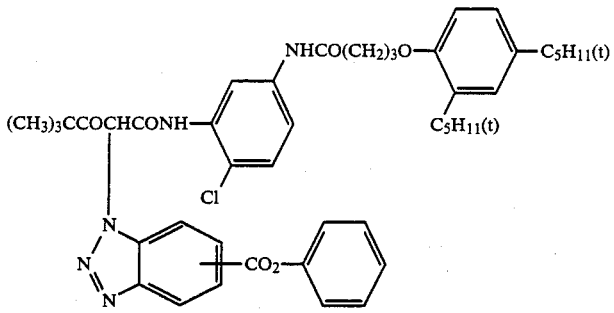

(Compound described in U.S. Pat. No. 4,477,563)

H-1

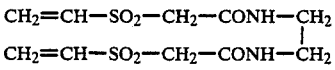

UV-1

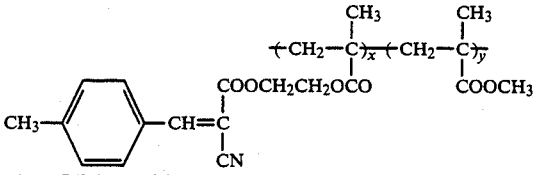

x/y = 7/3 (wt. ratio)

Sensitizing Dye I

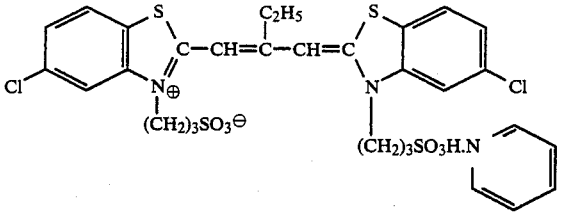

Sensitizing Dye II

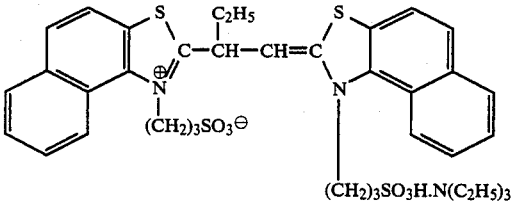

Sensitizing Dye III

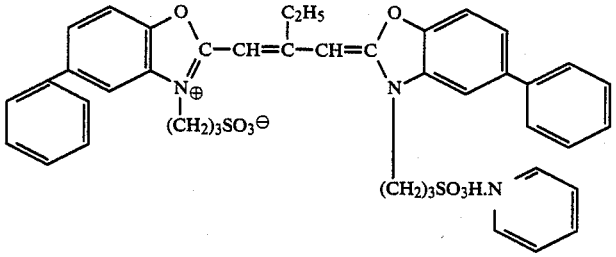

Sensitizing Dye IV

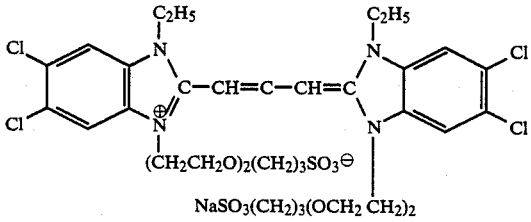

Samples 101 to 111 were subjected to wedge exposure to white light and then development processing at 38° C. according to the following processing steps.

1. Color Development: 3 min, 15 sec
2. Bleaching: 6 min, 30 sec
3. Washing with Water: 2 min, 10 sec 4. Fixing: 4 min, 20 sec
5. Washing with Water: 3 min, 15 sec
6. Stabilizing: 1 min, 05 sec The compositions of the processing solutions used for the above-described steps were as follows.

Color Developing Solution

Diethylenetriaminepentaacetic Acid: 1.0 g
1-Hydroxyethylidene-1,1-diphosphonic Acid: 2.0 g
Sodium Sulfite: 4.0 g
Potassium Carbonate: 30.0 g
Potassium Bromide: 1.4 g
Potassium Iodide: 1.3 mg
Hydroxylamine Sulfate: 2.4 g
4-(N-Ethyl-N-β-hydroxyethylamino)-2-methylaniline Sulfate: 4.5 g
Water to make: 1.0 liter
(pH 10.0)

Bleaching Solution

Ammonium Ethylenediaminetetraacetate Iron (III): 100.0 g
Disodium Ethylenediaminetetraacetate: 10.0 g
Ammonium Bromide: 150.0 g
Ammonium Nitrate: 10.0 g
Water to make: 1.0 liter
(pH 6.0)

Fixing Solution

Disodium Ethylenediaminetetraacetate: 1.0 g
Sodium Sulfite: 4.0 g
Ammonium Thiosulfate (70% aq. soln.): 175.0 ml
Sodium Hydrogensulfite: 4.6 g
Water to make: 1.0 liter
(pH 6.6)

Stabilizing Solution

Formaldehyde (40% aq. soln.): 2.0 ml
Polyoxyethylene p-Mononononylphenyl Ether (average polymerization degree: about 10): 0.3 g
Water to make: 1.0 liter The samples thus-processed exhibited almost the same sensitivity and gradation. The sharpness of the green-sensitive layers of these samples was evaluated using conventional MTF values at spatial frequencies of 25 cycles/mm. The results obtained are shown in the Table below.

TABLE

| Sample No. | DIR Compound in First Green-Sensitive Layer | Amount Added* | Main Coupler in First Green-Sensitive Layer | Amount Added* | DIR Compound in First Red-Sensitive Layer | Amount Added* | MTF Value of Green-Sensitive Layer (25 cycles/mm) |
|---|---|---|---|---|---|---|---|
| 101 (Comparison) | EX-9 | 1.0 | EX-4 | 1.0 | EX-9 | 1.0 | 0.61 |
| 102 (Comparison) | EX-11 | 1.0 | (51) | 0.8 | EX-12 | 1.0 | 0.60 |
| 103 (Comparison) | EX-12 | 1.0 | EX-10 | 1.0 | (14) | 2.0 | 0.61 |
| 104 (Comparison) | EX-14 | 2.0 | EX-13 | 0.8 | EX-14 | 2.0 | 0.62 |
| 105 (Comparison) | (8) | 1.5 | EX-4 | 1.0 | (15) | 2.0 | 0.62 |
| 106 (Invention) | (8) | 1.0 | (56) | 0.8 | EX-9 | 1.0 | 0.67 |
| 107 (Invention) | (9) | 2.5 | (57) | 1.0 | (47) | 1.0 | 0.68 |
| 108 (Invention) | (10) | 1.0 | (58) | 1.0 | EX-9 | 1.0 | 0.65 |
| 109 (Invention) | (11) | 2.0 | (66) | 0.8 | (27) | 1.0 | 0.68 |
| 110 (Invention) | (13) | 1.5 | (67) | 1.0 | EX-14 | 2.0 | 0.67 |
| 111 (Invention) | (47) | 0.7 | (71) | 1.0 | EX-9 | 1.0 | 0.69 |

*Amount added is indicated using a molar ratio taking the mole of the coupler used in Sample 101 as 1.

From the results shown in the Table above, it is apparent that the combination of the compounds according to the present invention remarkably improves the sharpness in comparison with the combination of the conventional compounds.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one silver halide emulsion layer, wherein said material contains at least one compound represented by general formula (I) described below and at least one compound represented by general formula (II) described below:

A—PDI (I)

wherein A represents a group capable of releasing PDI upon reaction with an oxidation product of a developing agent; and PDI represents a group which forms a development inhibitor upon reaction with an oxidation product of a developing agent after being released from A;

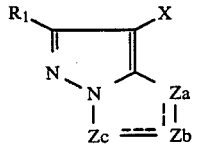

(II)

wherein $R_1$ represents a hydrogen atom or a substituent; X represents a hydrogen atom or a group capable of being released upon coupling; Za, Zb and Zc each represents a methine group, a substituted methine group, =N— or —NH—, wherein one of the Za—Zb bond and the Zb—Zc bond is a double bond and the other is a single bond; wherein $R_1$ or a substituted methine group represented by Za, Zb or Zc may be a divalent group which forms a polymer, including a dimer; and wherein X does not represent a group of a development inhibitor or a precursor thereof.

2. The silver halide color photographic material as claimed in claim 1, wherein the compound represented by general formula (I) is represented by general formula (III):

$$A—(L_1)_v—B—(L_2)_w—DI \quad (III)$$

wherein A represents a group capable of releasing $(L_1)_v$—B—$(L_2)_w$—DI upon reaction with an oxidation product of a developing agent; $L_1$ represents a group capable of releasing B—$(L_2)_w$—DI after being released from A; B represents a group capable of releasing $(L_2)_w$—DI upon reaction with an oxidation product of a developing agent after being released from A—$(L_1)_v$; $L_2$ represents a group capable of releasing DI after being released from B; DI represents a development inhibitor; and v and w each represents 0 or 1.

3. The silver halide color photographic material as claimed in claim 2, wherein the group represented by A represents a coupler residue or an oxidation reduction group.

4. The silver halide color photographic material as claimed in claim 3, wherein the oxidation reduction group represented by A is a group represented by general formula (IV):

$$A_1—P—(X{=}Y)_n—Q—A_2 \quad (IV)$$

wherein P and Q each represents an oxygen atom or a substituted or unsubstituted imino group; at least one of X and Y's represents a methine group having a group of —$(L_1)_v$—B—$(L_2)_w$—DI as a substituent, and the other of X and Y represents a substituted or unsubstituted methine group or a nitrogen atom; n represents an integer from 1 to 3 (when n is 2 or 3 each (X=Y) may be the same or different); $A_1$ and $A_2$ each represents a hydrogen atom or a group capable of being eliminated with an alkali; and any two substituents of P, X, Y, Q, $A_1$ and $A_2$ may be divalent groups and connected to each other to form a cyclic structure.

5. The silver halide color photographic material as claimed in claim 4, wherein the cyclic structure formed by $(X{=}Y)_n$ is a benzene ring or a pyridine ring.

6. The silver halide color photographic material as claimed in claim 2, wherein the group represented by $L_1$ or $L_2$ is a group represented by the following genral formula:

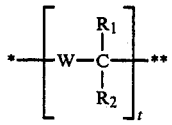

wherein a bond indicated by * denotes the position at which the group is connected to the left side group in general formula (III); a bond indicated by ** denotes the position at which the group is connected to the right side group in general formula (III), W represents an oxygen atom or a group represented by

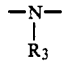

wherein $R_3$ represents an organic substituent); $R_1$ and $R_2$ each represents a hydrogen atom or a substituent; t represents 1 or 2, when t represents 2, two $R_1$'s and two $R_2$'s may be the same or different; and any two of $R_1$, $R_2$ and $R_3$ may be connected to each other to form a cyclic structure.

7. The silver halide color photographic material as claimed in claim 2, wherein the group represented by $L_1$ or $L_2$ is a group causing a cleavage reaction utilizing an intramolecular nucleophilic reaction.

8. The silver halide color photographic material as claimed in claim 2, wherein the group represented by $L_1$ or $L_2$ is a group causing a cleavage reaction utilizing an electron transfer reaction via a conjugated system.

9. The silver halide color photographic material as claimed in claim 2, wherein the group represented by $L_1$ or $L_2$ is a group represented by the following general formula:

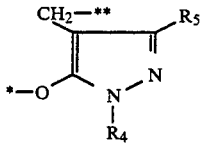

wherein a bond indicated by * denotes the position at which the group is connected to the left side group in general formula (III); a bond indicated by ** denotes the position at which the group is connected to the right side group in general formula (III); and $R_4$ and $R_5$ each represents a hydrogen atom or a substituent.

10. The silver halide color photographic material as claimed in claim 2, wherein the group represented by B is a group capable of forming a coupler after being released from A—$(L_1)_v$ or a group capable of forming an oxidation reduction group after being released from A—$(L_1)_v$.

11. The silver halide color photographic material as claimed in claim 10, wherein the group capable of forming a coupler is selected from a group which is formed by eliminating a hydrogen atom from a hydroxy group of a phenol type coupler and is connected to A—$(L_1)_v$ at an oxygen atom of the hydroxy group, and a group which is formed by eliminating a hydrogen atom from a hydroxy group of a 5-hydroxypyrazole which is a tautomer of a 5-pyrazolone type coupler and is connected to A—$(L_1)_v$ at an oxygen atom of the hydroxy group.

12. The silver halide color photographic material as claimed in claim 10, wherein the group capable of forming an oxidation reduction group is a group represented by general formula (B-1):

$$*—P—(X'{=}Y')_n—Q—A_2 \quad (B\text{-}1)$$

wherein a bond indicated by * denotes the position at which the group is connected to A—$(L_1)_v$—; $A_2$, P, Q and n each has the same meaning as defined in general formula (IV); at least one of X' and Y's represents a methine group having a group of $(L_2)_w$—DI as a substituent, and the other of X' and Y' represents a substituted or unsubstituted methine group or a nitrogen atom; and any two substituents of $A_2$, P, Q, X' and Y' may be divalent groups and connected to each other to form a cyclic structure.

13. The silver halide color photographic material as claimed in claim 2, wherein the group represented by DI is selected from the group consisting of a 5-aromatic group-substituted tetrazolylthio group, a 5-aliphatic group-substituted tetrazolylthio group, a benzimidazolylthio group, a benzothiazolylthio group, a benzoxazolylthio group, a benzotriazolyl group and a benzindazolyl group.

14. The silver halide color photographic material as claimed in claim 3, wherein A represents a coupler residue represented by general formula (Cp-1) or (Cp-2):

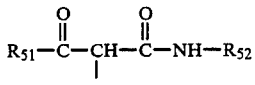
(Cp-1)

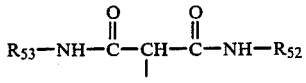
(Cp-2)

wherein $R_{51}$ represents an aliphatic group, an aromatic group, an alkoxy group or a heterocyclic group; and $R_{52}$ and $R_{53}$ each represents an aromatic group or a heterocyclic group.

15. The silver halide color photographic material as claimed in claim 3, wherein A represents a coupler residue represented by general formula (Cp-3), (Cp-4), (Cp-5) and (Cp-6):

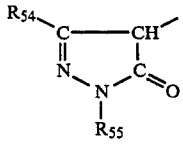
(Cp-3)

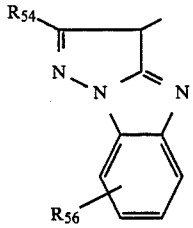
(Cp-4)

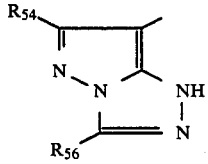
(Cp-5)

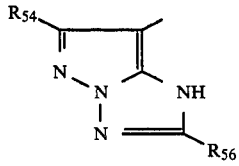
(Cp-6)

wherein $R_{55}$ represents a straight chain or branched chain alkyl group having from 1 to 32 carbon atoms, an alkenyl group, a cyclic alkyl group, an aralkyl group or a cyclic alkenyl group, each of which may be substituted with a substituent selected from a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group and a mercapto group; an aryl group, which may be substituted with a substituent selected from an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxy group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group and a hydroxy group; a heterocyclic group which may be substituted with a substituent selected from the substituents as defined for the above-described aryl group; an aliphatic acyl group; an aromatic acyl group; an alkylsulfonyl group; an arylsulfonyl group; an alkylcarbamoyl group; an arylcarbamoyl group; an alkylthiocarbamoyl group; or an arylthiocarbamoyl group; $R_{54}$ represents a hydrogen atom; a straight chain or branched chain alkyl group having 1 to 32 carbon atoms, an alkenyl group, a cyclic alkyl group, an aralkyl group, a cyclic alkenyl group, an aryl group or a heterocyclic group, each of which may be substituted with a substituent selected from the substituents as defined for these groups of $R_{55}$ respectively; an alkoxycarbonyl group; an aryloxycarbonyl group; an aralkyloxycarbonyl group; an alkoxy group; an aryloxy group; an alkylthio group; an arylthio group; a carboxy group; an acylamino group; a diacylamino group; an N-alkylacylamino group; an N-arylacylamino group; a ureido group; a urethane group; a thiourethane group; an arylamino group; an alkylamino group, a cycloamino group; a heterocyclic amino group; an alkylcarbonyl group; an arylcarbonyl group; a sulfonamido group; a carbamoyl group; a sulfamoyl group; a cyano group; a hydroxy group; or a sulfo group; and $R_{56}$ represents a hydrogen atom; a straight chain or branched chain alkyl group having from 1 to 32 carbon atoms, an alkenyl group, a cyclic alkyl group, an aralkyl group, a cyclic alkenyl group, an aryl group or a heterocyclic group, each of which may be substituted with a substituent selected from the substituents as defined for these groups of $R_{55}$ respectively; a cyano group; an alkoxy group, an aryloxy group, a halogen atom, a carboxyl group, an alkoxycarbonyl group, an aryloxycarbonyl group, an acyloxy group, a sulfo group, an acyl group, a sulfamoyl group, a carbamoyl group, an acylamino group, a diacylamino group, a ureido group, a urethane group, a sulfonamido group, an arylsulfonyl group, an alkylsulfonyl group, an arylthio group, an alkylthio group, an alkylamino group, a dialkylamino group, an anilino group, an N-aylanilino group, an N-alkylanilino group, an N-acylanilino group or a hydroxy group.

16. The silver halide color photographic material as claimed in claim 3, wherein A represents a coupler residue represented by general formula (Cp-7), (Cp-8) or (Cp-9):

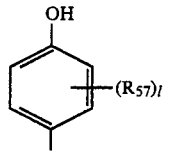
(Cp-7)

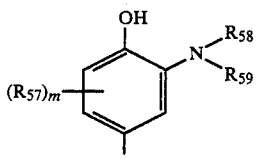
(Cp-8)

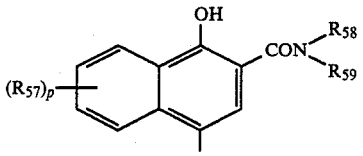
(Cp-9)

wherein $R_{57}$ represents a hydrogen atom, a halogen atom, an alkoxycarbonylamino group, an aliphatic hydrocarbon residue, an N-arylureido group, a sulfamoyl group, a sulfonamido group, an acylamino group, an —O—$R_{62}$ group or an —A—$R_{62}$ group (wherein $R_{62}$ represents an aliphatic hydrocarbon residue); $R_{58}$ and $R_{59}$ each represents an aliphatic hydrocarbon residue, an aryl group or a heterocyclic group, one of $R_{58}$ and $R_{59}$ may be a hydrogen atom, or $R_{58}$ and $R_{59}$ may combine with each other to form a nitrogen-containing heterocyclic nucleus; l represents an integer of 1 to 4; m represents an integer of 1 to 3; and p represents an integer of 1 to 5.

17. The silver halide color photographic material as claimed in claim 3, wherein A represents a coupler residue represented by general formula (Cp-10) or (Cp-11):

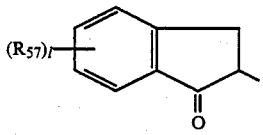
(Cp-10)

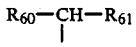
(Cp-11)

wherein $R_{60}$ represents an arylcarbonyl group, an alkanoyl group having from 2 to 32 carbon atoms, an arylcarbamoyl group, an alkanecarbamoyl group having from 2 to 32 carbon atoms, an alkoxycarbonyl group having from 1 to 32 carbon atoms or an aryloxycarbonyl group, each of which may be substituted with a substituent selected from an alkoxy group, an alkoxycarbonyl group, an acylamino group, an alkylsulfamoyl group, an alkylsulfonamido group, an alkylsuccinimido group, a halogen atom, a nitro group, a carboxy group, a nitrile group, an alkyl group and an aryl group; and $R_{61}$ represents an arylcarbonyl group, an alkanoyl group having from 2 to 32 carbon atoms, an arylcarbamoyl group, an alkanecarbamoyl group having from 2 to 32 carbon atoms, an alkoxycarbonyl group having from 1 to 32 carbon atoms, an aryloxycarbonyl group, an alkylsulfonyl group having from 1 to 32 carbon atoms, an arylsulfonyl group, an aryl group or a 5-membered or 6-membered heterocyclic group, each of which may be substituted with a substituent selected from the substituents as defined for $R_{60}$; $R_{57}$ represents a hydrogen atom, a halogen atom, an alkoxycarbonylamino group, an aliphatic hydrocarbon residue, an N-arylureido group, a sulfamoyl group, a sulfonamido group, an acylamino group, an —O—$R_{62}$ group or an —S—$R_{62}$ group (wherein $R_{62}$ represents an aliphatic hydrocarbon residue); and l represents an integer of 1 to 4.

18. The silver halide color photographic material as claimed in claim 4, wherein P and Q each represents a substituted or unsubstituted imino group.

19. The silver halide color photographic material as claimed in claim 18, wherein P and Q each represents an imino group substituted with a sulfonyl group or an acyl group.

20. The silver halide color photographic material as claimed in claim 19, wherein P and Q each represents a group represented by general formula (N-1) or (N-2):

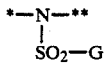
(N-1)

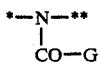
(N-2)

wherein a bond indicated by * denotes the position at which the group is connected to $A_1$ or $A_2$; a bond indicated by ** denotes the position at which the group is connected to one of the free fonds of —(X=Y)$_n$—; and G represents an aliphatic group containing from 1 to 32 carbon atoms which may be substituted, an aromatic group containing from 6 to 10 carbon atoms which may be substituted or a 4-membered, 5-membered, 6-membered or 7-membered heterocyclic group containing as a hetero atom a nitrogen atom, a sulfur atom or an oxygen atom.

21. The silver halide color photographic material as claimed in claim 4, wherein P represents an oxygen atom and $A_2$ represents a hydrogen atom.

22. The silver halide color photographic material as claimed in claim 4, wherein the group represented by general formula (IV) is a group represented by general formula (V) or (VI):

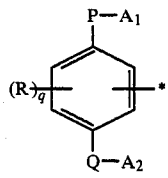
(V)

-continued (VI)

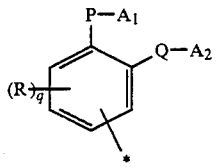

wherein a bond indicated by * denotes the position at which the group is connected to $-(L_1)_v-B-(L_2)_w-DI$; P, Q, $A_1$ and $A_2$ each has the same meaning as defined in general formula (IV); R represents a substituent; q represents an integer of 0, 1, 2 or 3; and when q represents 2 or 3, two or three R's may be the same or different, or when two R's represent substituents positioned on the adjacent two carbon atoms, they may be divalent groups and connected to each other to form a cyclic structure.

23. The silver halide color photographic material as claimed in claim 22, wherein the substituent represented by R is selected from an aliphatic group, an aromatic group, a halogen atom, an alkoxy group, an alkylthio group, an aryloxy group, an arylthio group, a carbamoyl group, an alkoxycarbonyl group, an aryloxycarbonyl group, a sulfonyl group, a sulfamoyl group, an acylamino group, a sulfonamido group, an acyl group, a nitroso group, an acyloxy group, a ureido group, a nitro group, a cyano group, a heterocyclic group, a hydroxy group, a carboxy group, an alkoxycarbonylamino group, a sulfo group, an amino group, an arylamino group, an aliphatic amino group, a sulfinyl group, a sulfamoylamino group, a thioacyl group, a thioureido group, a heterocyclic thio group, an imido group and a heterocyclic amino group.

24. The silver halide color photographic material as claimed in claim 2, wherein the group represented by B is a group represented by general formula (B-2) or (B-3):

(B-2)

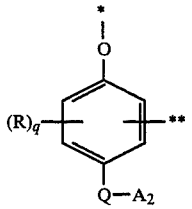

(B-3)

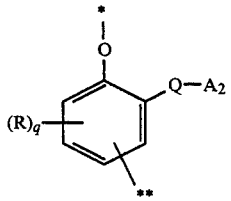

wherein a bond indicated by * denotes the position at which the group is connected to $A-(L_1)_v-$; a bond indicated by ** denotes the position at which the group is connected to $-(L_2)_w-DI$; and R, q, Q and $A_2$ each has the same meaning as defined in general formula (V) or (VI).

25. The silver halide color photographic material as claimed in claim 1, wherein the compound represented by general formula (II) is represented by general formula (VII), (VIII), (IX), (X) or (XI):

(VII)

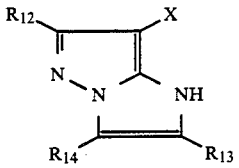

(VIII)

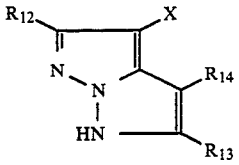

(IX)

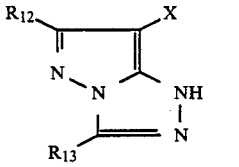

(X)

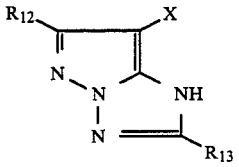

(XI)

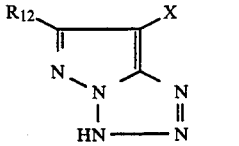

wherein $R_{12}$, $R_{13}$ and $R_{14}$, which may be the same or different, each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, a arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; and X has the same meaning as defined in general formula (II), or $R_{12}$, $R_{13}$, $R_{14}$ or X may be a divalent group to form a bis coupler.

26. The silver halide color photographic material as claimed in claim 25, wherein the compound represented by general formula (II) is a polymer coupler in which the coupler moiety derived from the compound represented by general formula (VII), (VIII), (IX), (X) or (XI) is present in a vinyl monomer, and $R_{12}$, $R_{13}$ or $R_{14}$ represents a chemical bond or a linking group, through which the coupler moiety is connected to the vinyl group.

27. The silver halide color photographic material as claimed in claim 25, wherein the divalent group to form a bis coupler represented by $R_{12}$, $R_{13}$ or $R_{14}$ is a substituted or unsubstituted alkylene group, a substituted or unsubstituted phenylene group or a group of the formula —NHCO—R—CONH—, wherein R represents a substituted or unsubstituted alkylene group or a substituted or unsubstituted phenylene group.

28. The silver halide color photographic material as claimed in claim 26, wherein the linking group represented by $R_{12}$, $R_{13}$ or $R_{14}$ is a substituted or unsubstituted alkylene group, a substituted or unsubstituted phenylene group, —NHCO—, —CONH—, —O—, —OCO—, an aralkylene group or a combination thereof.

29. The silver halide color photographic material as claimed in claim 26, wherein the vinyl group may further have a substituent selected from a chlorine atom and a lower alkyl group having from 1 to 4 carbon atoms in addition to the coupler moiety.

30. The silver halide color photographic material as claimed in claim 26, wherein the polymer coupler is a copolymer containing a repeating unit derived from a noncolor-forming ethylenic monomer which does not couple with the oxidation product of an aromatic primary amine developing agent.

31. The silver halide color photographic material as claimed in claim 1, wherein the compound represented by general formula (I) and the compound represented by general formula (II) are present in the same layer.

32. The silver halide color photographic material as claimed in claim 1, wherein the compound represented by general formula (II) is present in a light-sensitive silver halide emulsion layer.

33. The silver halide color photographic material as claimed in claim 1, wherein said compound represented by general formula (I) is employed in an amount of from $1\times10^{-7}$ to 0.5 mol/mol of silver present in the same layer or an adjacent layer.

34. The silver halide color photographic material as claimed in claim 1, wherein said compound represented by general formula (II) is employed in an amount of from $1\times10^{-6}$ to 1 mol/mol of silver present in the same layer or an adjacent layer.

35. The silver halide color photographic material as claimed in claim 1, wherein the molar ratio of said compound represented by general formula (I) and said compound represented by general formula (II) is from 0.01/99.99 to 50/50.

* * * * *